US007296424B2

(12) United States Patent
Thompson

(10) Patent No.: US 7,296,424 B2
(45) Date of Patent: Nov. 20, 2007

(54) MOUNTING SYSTEM AND METHOD FOR MOUNTING AN AIR CONDITIONER

(75) Inventor: Christopher M. Thompson, Franklin, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 244 days.

(21) Appl. No.: 11/239,560

(22) Filed: Sep. 29, 2005

(65) Prior Publication Data

US 2007/0068185 A1 Mar. 29, 2007

(51) Int. Cl.
*F25B 1/00* (2006.01)
*F25D 23/12* (2006.01)

(52) U.S. Cl. ..... 62/115; 62/262; 62/263

(58) Field of Classification Search ..... 62/115, 62/262, 263, 297, 298, 302; 248/208, 657, 248/354.1; 454/203, 204

See application file for complete search history.

(56) References Cited

U.S. PATENT DOCUMENTS

| | | | | | |
|---|---|---|---|---|---|
| 2,717,139 | A | | 9/1955 | Jewell | |
| 2,758,456 | A | | 8/1956 | Wheeler | 62/129 |
| 2,810,335 | A | * | 10/1957 | Bilgrei | 454/204 |
| 3,543,533 | A | | 12/1970 | Oberdier | 62/262 |
| 3,548,611 | A | | 12/1970 | Ulich | 62/262 |
| 3,552,139 | A | | 1/1971 | Ulich | 62/262 |
| 3,576,114 | A | | 4/1971 | Sharp | 62/262 |
| 3,602,006 | A | | 8/1971 | Metcalfe | 62/262 |
| 3,665,726 | A | * | 5/1972 | Preotle | 62/262 |
| 4,510,852 | A | | 4/1985 | Sorrentino | 62/262 |
| 4,641,503 | A | * | 2/1987 | Kobayashi | 62/259.1 |
| 4,768,350 | A | * | 9/1988 | Moran, Jr. | 62/259.1 |
| 5,027,614 | A | * | 7/1991 | Mori et al. | 62/262 |
| 5,295,903 | A | * | 3/1994 | Bolton et al. | 454/203 |
| 5,386,702 | A | * | 2/1995 | Wiesen | 62/262 |
| 5,582,025 | A | * | 12/1996 | Dubin et al. | 62/262 |
| 5,636,816 | A | | 6/1997 | Burton et al. | 248/208 |
| 5,660,605 | A | * | 8/1997 | Chan et al. | 96/19 |
| 6,389,834 | B1 | * | 5/2002 | LeClear et al. | 62/280 |
| 6,401,476 | B1 | * | 6/2002 | Zhu et al. | 62/262 |
| 6,568,201 | B1 | * | 5/2003 | Cur et al. | 62/262 |

FOREIGN PATENT DOCUMENTS

JP 59-15734 A * 1/1984

* cited by examiner

*Primary Examiner*—Mohammad M. Ali
(74) *Attorney, Agent, or Firm*—John F. Colligan; Michael D. Lafrenz

(57) ABSTRACT

A mounting system is provided for mounting an air conditioner on the exterior of a building adjacent to a window with an opening defined by a window frame having a lower sill and a height to an upper horizontal frame member. The air conditioner includes a main cabinet and a removable air duct. The mounting system includes two mounting arms, each arm being attached at a first point to a wall of the main cabinet and at a second point being engaged to the frame of the window. The main cabinet is suspended from the two mounting arms such that when mounted, a top surface of the main cabinet is positioned at a height of no more than 10% of the height of the window opening above the sill. The mounting system may provide support for the air conditioner at three points, namely, the sill of the window, an inside casing of the window and an exterior surface of the building, without requiring any fasteners to be driven into any of these points.

29 Claims, 22 Drawing Sheets

MOUNTING SYSTEM AND METHOD FOR MOUNTING AN AIR CONDITIONER

BACKGROUND OF THE INVENTION

The present invention relates generally to a mounting system for an air conditioner.

Air conditioners are oftentimes mounted in or adjacent to a window for the room such that at least a portion of the air conditioner is located outside of the room while the air conditioner is operating in order to prevent hot air associated with the condenser from entering the room that is being cooled. Many air conditioners are too large for them to merely rest on the window sill, with the partially closed window holding the air conditioner in place. Therefore, various types of mounting systems have been suggested in the art.

For example, in U.S. Pat. No. 5,636,816, a bracket arrangement is disclosed that attaches, such as with screws, to the exterior window sill, and rests upon a strut pressed against the exterior siding of the building below the window. A variety of spacer blocks and vibration absorbing blocks are involved in the bracket arrangement. In U.S. Pat. No. 2,758,456, a bracket arrangement is disclosed that attaches to the interior window sill, such as by screws, and also rests upon a strut pressed against the exterior siding of the building below the window. In U.S. Pat. No. 2,717,139, a bracket arrangement is disclosed that clamps to an interior portion of the window sill, and also rests upon a strut pressed against the exterior siding of the building below the window. In each of these mounting systems, the bracket arrangements are installed prior to the air conditioner being placed on the bracket arrangement, and the air conditioner, in use, is positioned in the window opening, partially extending exterior of the room, and partially extending into the room. Also, in each case, to close the window fully or winterize the window, the air conditioner is required to be removed and stored in some other location.

U.S. Patent No. 4,510,852 discloses a mounting assembly for a room air conditioner that attaches on the inside of the room, above the window, and holds the air conditioner inside the room, until the air conditioner is to be used. At that point, the air conditioner is rolled on the mounting assembly to a position where it partially extends outside of the window by overhanging a portion of the mounting assembly. With this mounting assembly, the room air conditioner must be lifted to the elevated position of the upper window of a double hung window, and slid into an opening of the support frame. This mounting arrangement is useful only with double hung windows.

U.S. Pat. Nos. 3,543,533, 3,548,611, 3,552,139 and 3,602,006 all disclose a mounting arrangement for an air conditioner in which the operating components of the air conditioner depend along an outside building wall below a window, with a main body of the air conditioner projecting up into the window opening space. The air conditioner is attached to the window sill by screws and rests against the exterior siding of the building on a horizontal support foot. To install the air conditioner, either the installation takes place from the exterior of the building, if installed in a first floor window, or the person installing the air conditioner must blindly align a flanged support member with a channeled receiving track that is attached to a sill of the window opening.

It would be an improvement in the art if a mounting system were provided for an air conditioner that would address the problems of the prior art.

SUMMARY OF THE INVENTION

The present invention provides a mounting system and a method of mounting an air conditioner that address problems associated with prior art mounting systems and methods. Some of the benefits and advantages provided by various embodiments of the present invention include simplicity and security of installation, installation without using any separate fasteners, such as screws or bolts, to retain the air conditioner in its installed and operating position, ability to open and close the window to allow outside air to enter the room while the air conditioner is in place, increased visibility through the window while the air conditioner is in place and operating, virtually unlimited visibility through the window while the air conditioner is in a winterized condition, without moving or removing the main cabinet of the air conditioner, low noise transmission into the room being cooled, and portable controls situated at convenient location in the area being cooled.

In an embodiment, a mounting system is provided for an air conditioner that has a cabinet for receiving the components of the air conditioner. The mounting system comprises two mounting arms with each arm having a first length slidably attached at one end to a side wall of the cabinet, and a second length secured to a second end of the first length to provide an adjustable length for the arm, the two mounting arms being attached to opposite side walls of the cabinet. A cross bar is engaged with a free end of each of the second lengths and extends to ends positioned laterally beyond the side walls of the cabinet.

In an embodiment, the first length of each arm is pivotably attached to the cabinet.

In an embodiment, the first length of each arm includes ratchet teeth engagable with a ratchet pawl carried on the cabinet.

In an embodiment, a bearing pin projects from the opposite walls of the cabinet, and the first length of each arm is slidably mounted on one of the bearing pins.

In an embodiment, each arm includes a glide track for receiving the bearing pin.

In an embodiment, the mounting system further comprises a pad secured to a wall of the cabinet and frictionally engagable with an exterior surface of a building where the air conditioner is to be used.

In an embodiment, low friction skid rails are applied to an exterior of a wall of the air conditioner cabinet.

In an embodiment, non-marring and non-skidding pads are applied to the cross bar.

In an embodiment, the cross bar includes lateral stops positioned intermediate the ends of the cross bar.

In an embodiment, a three point mounting system is provided for mounting an air conditioner on the exterior of a building adjacent to a window, wherein the air conditioner is supported solely by a sill of the window, an inside casing of the window and an exterior surface of the building. The mounting system comprises a first and second mounting arm, each attached at one end to a left and right side of a cabinet of the air conditioner. A cross bar is engaged with a second end of the first and second mounting arms, and a pad is secured to a wall of the air conditioner cabinet, wherein the first and second mounting arms rest on the window sill, the cross bar engages an inside face of the inside casing and the pad engages the exterior surface of the building.

In an embodiment, the air conditioner hangs suspended from the first and second mounting arms.

In an embodiment, the first and second mounting arms are pivotally attached to the air conditioner.

In an embodiment, the first and second mounting arms are slidably attached to the air conditioner.

In an embodiment, a length of the arms is adjustable.

In an embodiment, the first and second arms include a linear ratchet.

In an embodiment, a combination of an air conditioner and a mounting system is provided for mounting the air conditioner on the exterior of a building adjacent to a window with an opening defined by a window frame having a lower sill and a height to an upper horizontal frame member. The combination comprises the air conditioner including a main cabinet and a removable air duct. The combination further comprises the mounting system including two mounting arms, each arm being attached at a first point to a wall of the main cabinet and at a second point being engaged to the frame of the window, the arms having an adjustable length, wherein the main cabinet is suspended from the two mounting arms such that when mounted, a top surface of the main cabinet is positioned at a height of no more than 10% of the height of the window opening above the sill of the window frame.

In an embodiment, the arms have an adjustable length.

In an embodiment, the mounting system further includes a pad secured to the main cabinet and positioned to engage an exterior surface of the building.

In an embodiment, each of the arms is attached to the wall such that the arm is slidable relative to the main cabinet.

In an embodiment, the air duct is attached to the top surface of the main cabinet and has a portion extending into the window opening.

In an embodiment, each of the second points of the mounting arms is engaged to the window frame by means of one or more brackets secured to the window sill, each of the arms being bolted to a bracket.

In an embodiment, the second points of the mounting arms are engaged to the frame by means of a cross bar engaging a room side face of the window frame and the arms being attached to the cross bar.

In an embodiment, a method is provided of installing an air conditioner having a cabinet through an opening of a predetermined width in a wall of a building from a room side of the wall. The method comprises the steps of:

attaching an arm to the cabinet of the air conditioner such that a free end of the arm is positioned away from the cabinet, attaching a cross bar with a length greater than the width of the opening to the arm at the free end, lifting the air conditioner cabinet and inserting it into the opening from the room side of the wall with the arm and the cross bar positioned toward an interior of the room, setting the air conditioner cabinet on a sill of the opening, and sliding the air conditioner further out of the opening, while holding the cross bar, until the air conditioner is fully outside of the building and the cross bar engages a room side face of the wall surrounding the opening.

In an embodiment, the step of attaching an arm comprises attaching two arms to the cabinet, and the step of attaching a cross bar comprises attaching the cross bar to a free end of both arms.

In an embodiment, the step of attaching an arm comprises attaching the arm in a slidable fashion to the cabinet.

In an embodiment, the method further includes the step of sliding the cabinet on the arms toward the building after the air conditioner is positioned fully outside of the building.

In an embodiment, the step of attaching a cross bar to the arm comprises sliding the cross bar into an opening in the arm.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention provides a mounting system for and a method of mounting an air conditioner on the exterior of a building adjacent to a window or other opening in the building. Particular embodiments of the invention are illustrated, however the scope of the invention is not limited to the particular embodiments illustrated.

Figure 1:
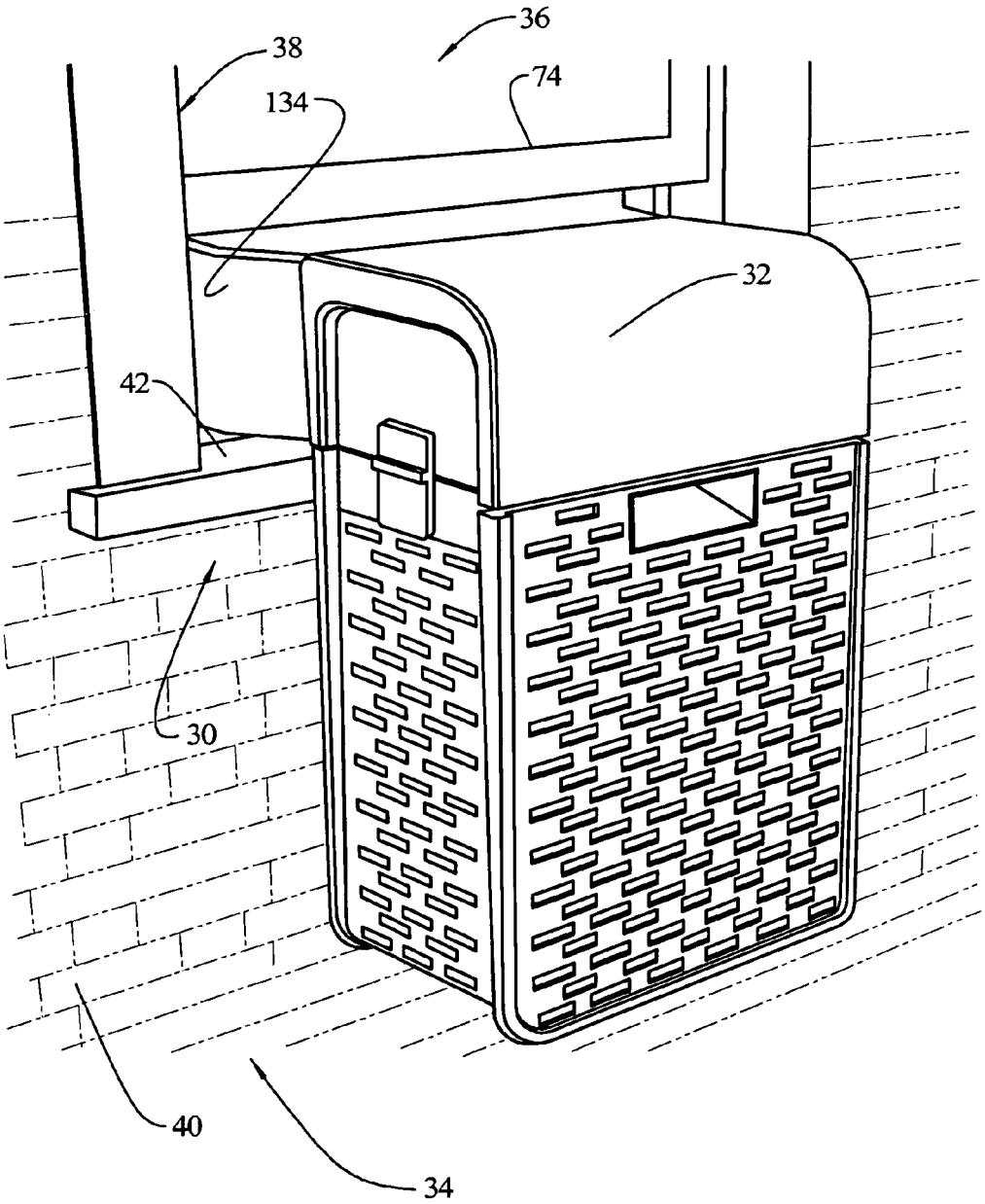
FIG. 1 is a perspective view of an air conditioner utilizing a mounting system embodying the principles of the present invention, as viewed from an exterior of a building having a space being cooled by the air conditioner.
Figure 2:
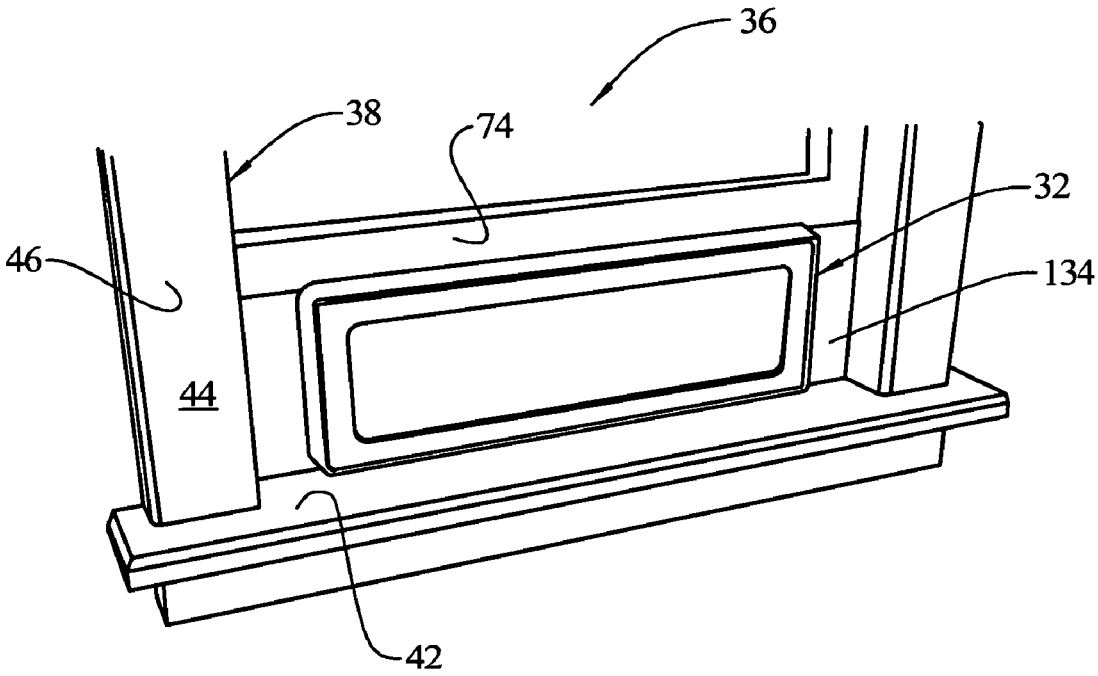
FIG. 2 is a perspective view of the air conditioner of FIG. 1 as viewed from the interior of the space being cooled.
Figure 3:
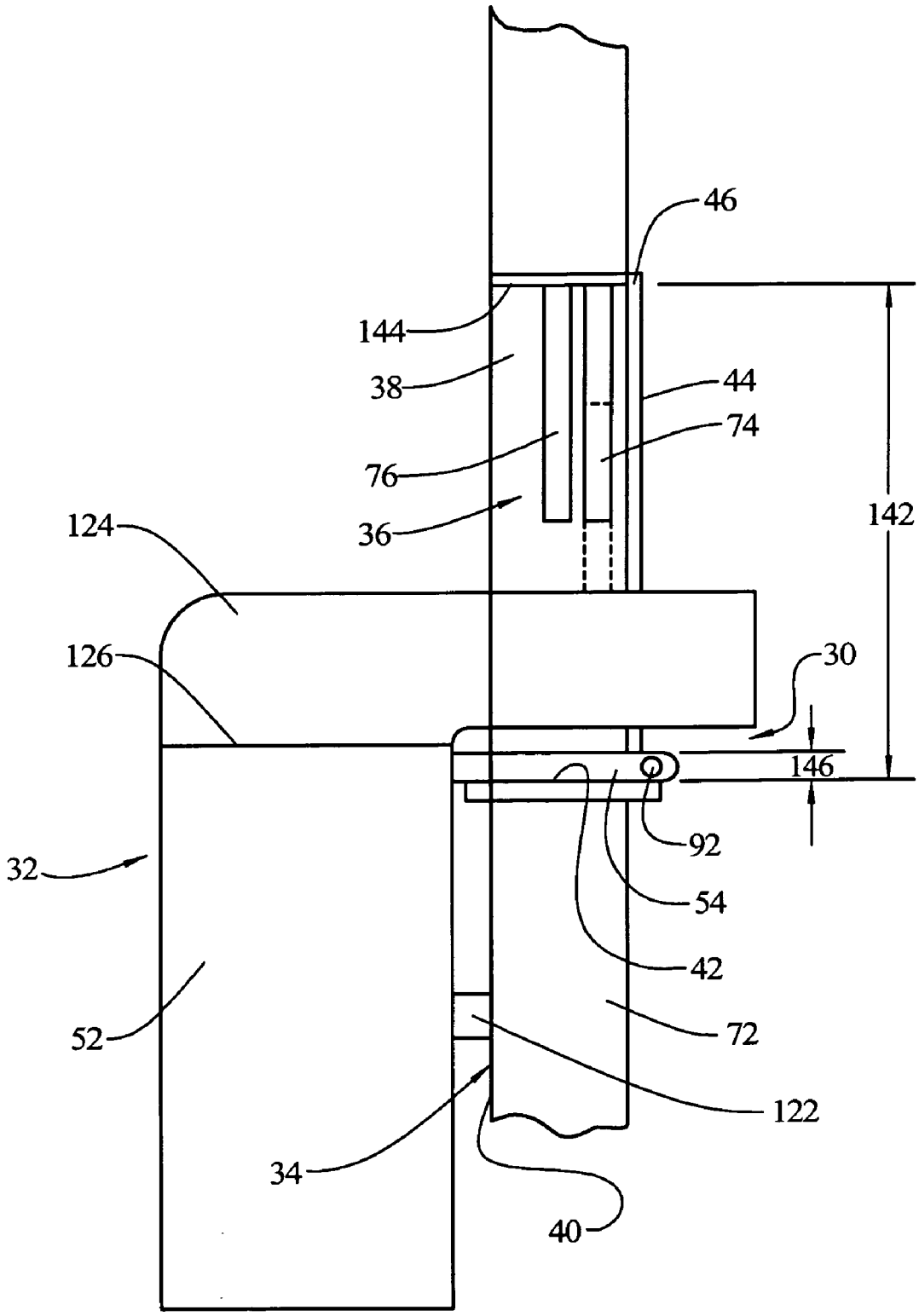
FIG. 3 is a side elevational view of the air conditioner of FIG. 1 in a cross-section of a wall of the building.
Figure 4:
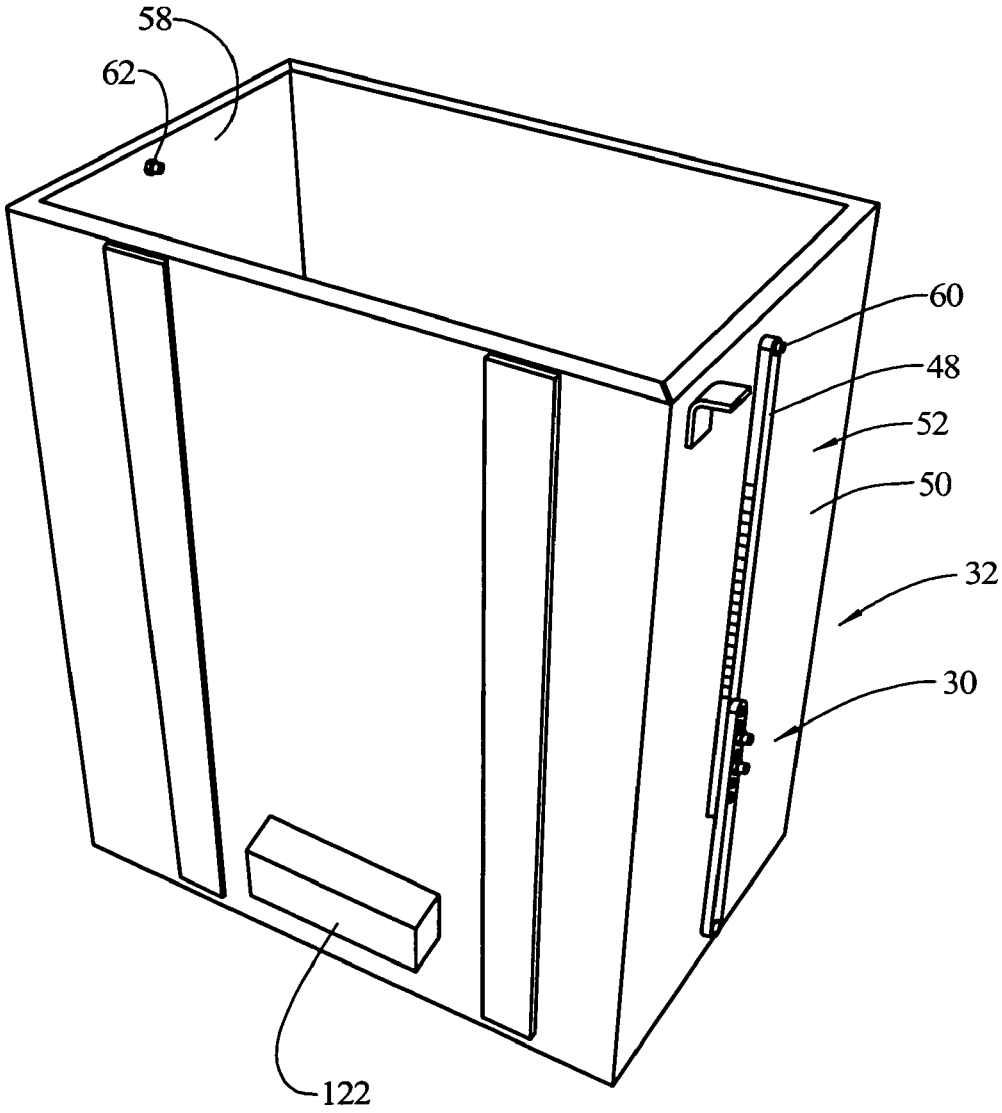
FIG. 4 is a perspective view of a main cabinet of an air conditioner with an embodiment of the mounting system embodying the present invention.

In an embodiment, as illustrated in FIGS. 1-3, a mounting system 30 is provided for mounting an air conditioner 32 on the exterior of a building 34 adjacent to a window 36, wherein the air conditioner is supported solely by a frame 38 of the window and perhaps an exterior siding 40 of the building. In some embodiments, the support by the frame 38 is solely through a sill 42 of the frame and in other embodiments, the support by the frame is through the sill and through a vertical face 44 of an interior casing 46 of the frame. In the case of casingless window frames, a vertical face of the wall surrounding the window may substitute for the vertical face 44 of the casing 46.

In this mounting arrangement, all of the electrical and mechanical components of the air conditioner 32, such as the compressor, the evaporator, the fans and blowers, and the pumps are located on the exterior of the building, and principally below the window. This allows for a significant reduction in the noise being transmitted to the room being cooled, putting this type of air conditioner substantially on a par with central air conditioners, with respect to noise levels. The entire weight of the air conditioner, which may be in the range of 65 to 100 pounds, is supported by the mounting system 30 as described.

Figure 7:
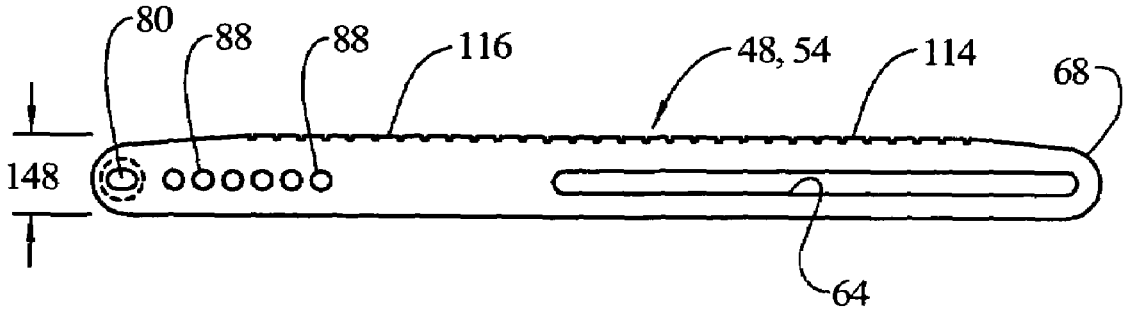
FIG. 7 is side elevational view of an outer arm of the mounting arm of FIG. 5.
Figure 8:
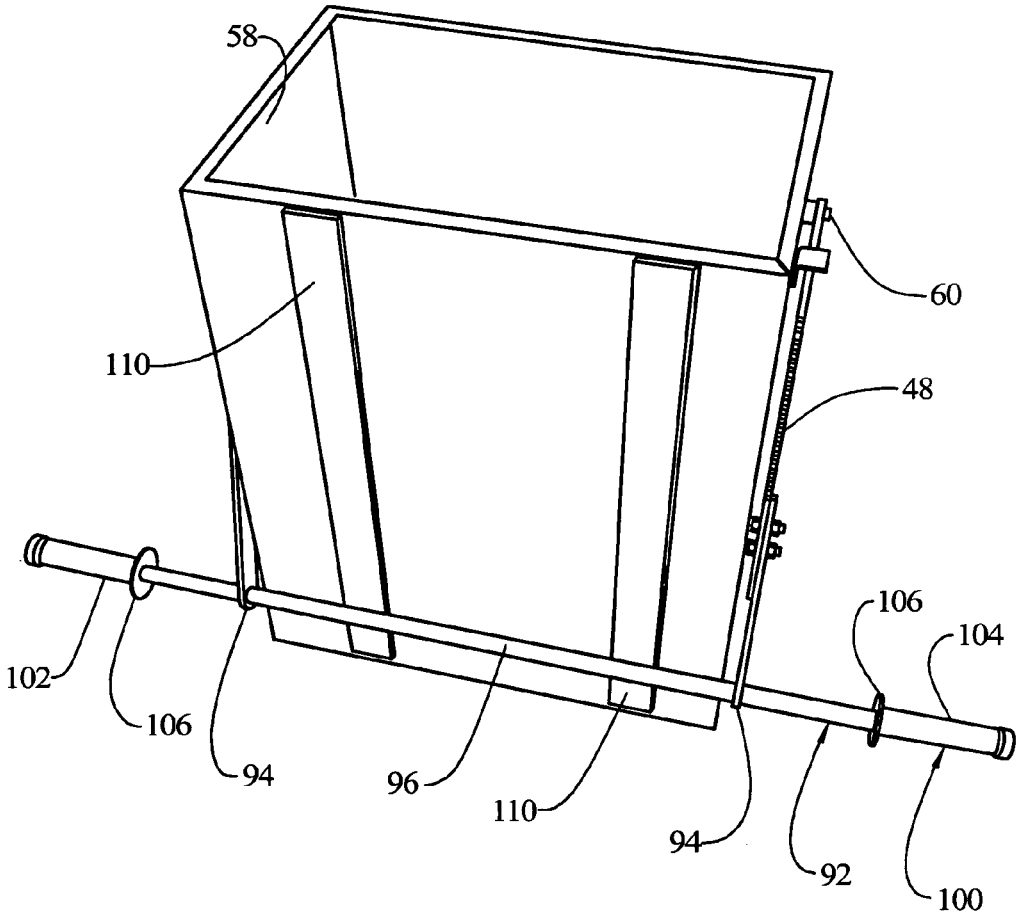
FIG. 8 is a perspective view of the main cabinet of FIG. 4 with additional components of the mounting system assembled.
Figure 9:
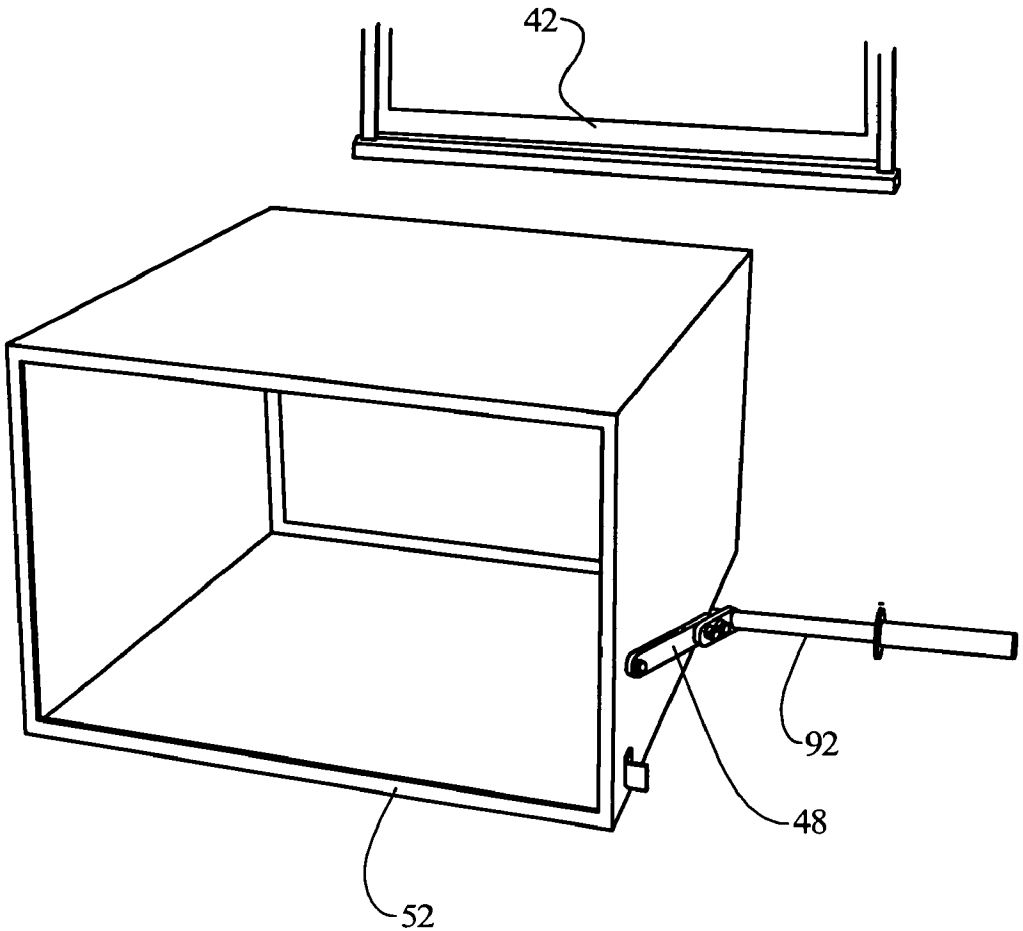
FIG. 9 is a perspective view of the main cabinet of FIG. 4 being moved towards a window opening for mounting.
Figure 10:
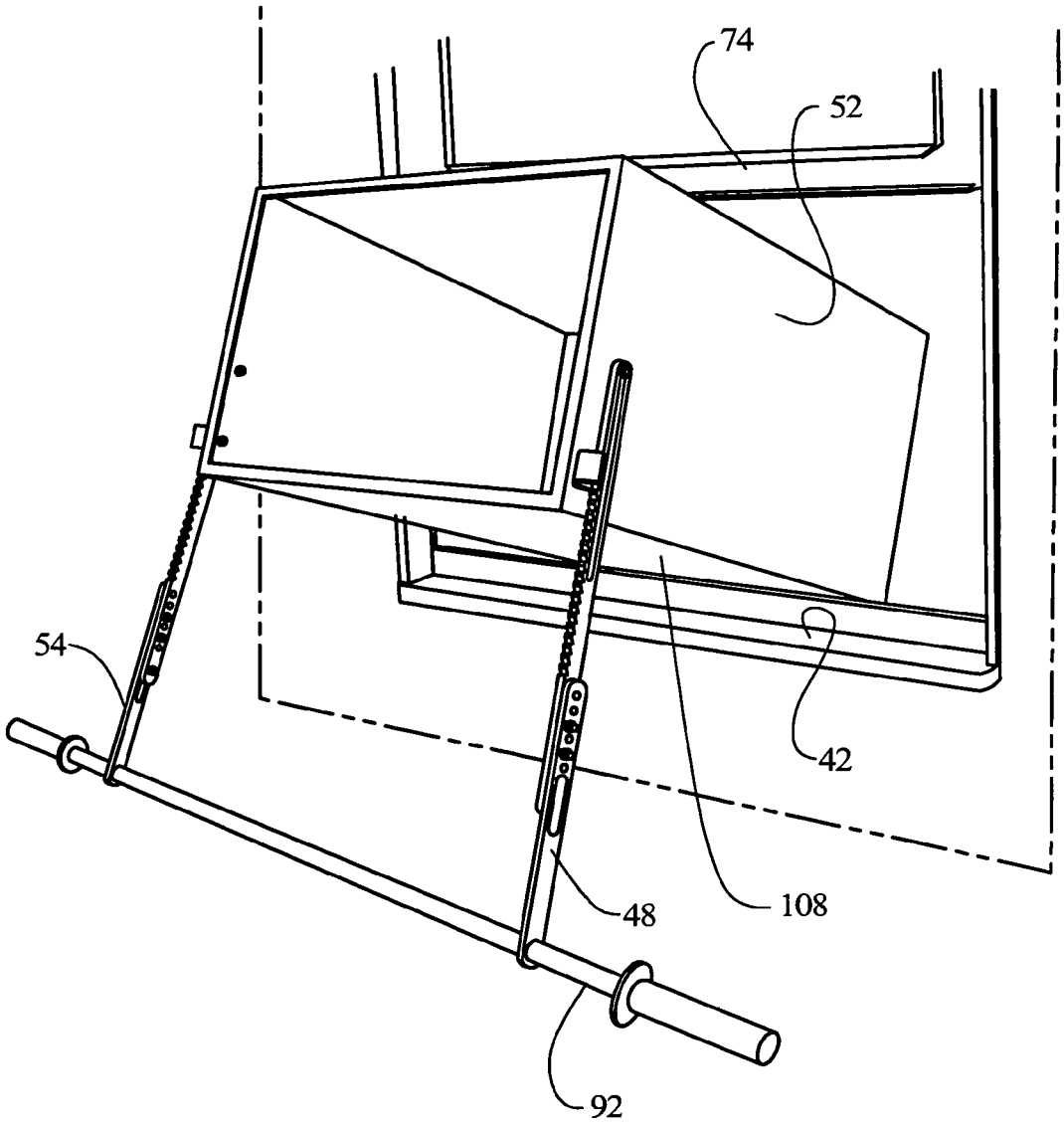
FIG. 10 is a perspective view of the main cabinet of FIG. 4 being inserted through the window opening.
Figure 11:
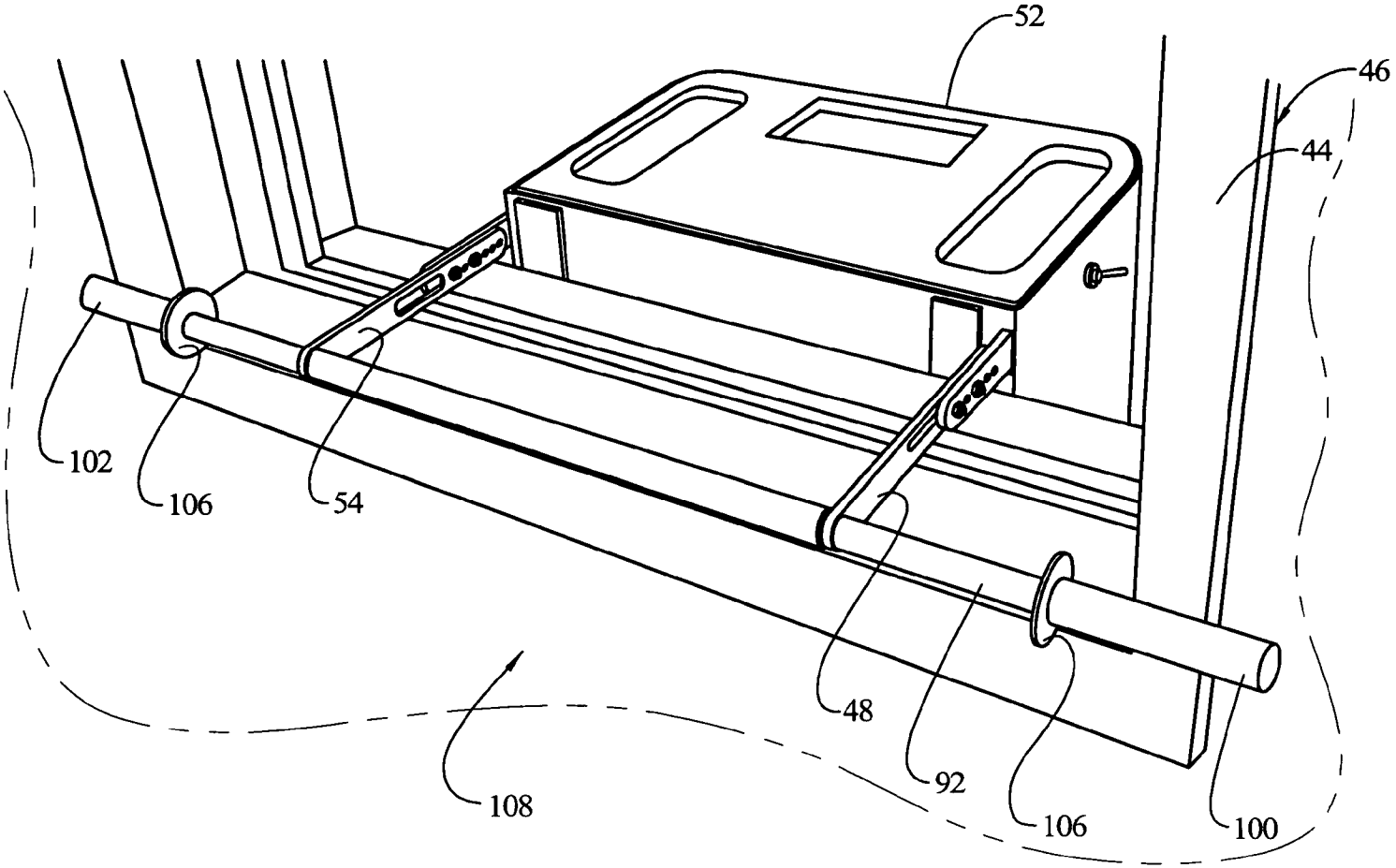
FIG. 11 is a perspective view of the main cabinet of FIG. 4 mounted outside the window, as viewed from inside.

A specific embodiment of the mounting system 30 is illustrated in FIGS. 4-14. In this embodiment, the mounting system 30 comprises a mounting arm 48 attached to a wall 50 of a main cabinet 52 of the air conditioner 32 (FIG. 4), and as shown in FIG. 8, two mounting arms 48, 54, each attached at one end 56 to a left and right side wall 50, 58 of the main cabinet 52 of the air conditioner 30. In other embodiment, the mounting arm or arms 48, 54 (two or more) may be secured to different walls or portions of the main cabinet 52 than the two walls illustrated. The mounting arm or arms 48, 54 may attach to the main cabinet 52 in a sliding manner, or in a pivoting manner or both. To provide a sliding attachment, a bearing pin 60 (FIG. 4) may be secured, such as with threaded fastening elements 62, or by welding, or other fastening means, to the side walls 50, 58 of the main cabinet 52. The mounting arm 48, 54 may have a slot or glide track 64 (FIG. 7) for receiving the bearing pin 60, and a washer or enlarged head 66 on the bearing pin may assure that the arm will not come free from the bearing pin while in use. With the mounting arm 48, 54 attached via the bearing pin 60, and the slot 64 in the arm, the arm will also be pivotable or rotatable relative to the main cabinet 52, unless otherwise constrained, as will be described in some situations below. The mounting arm 48, 54 may also be attached via the bearing pin 60 through a circular hole in the arm, rather than through a slot 64 as shown, in which case the arm will be pivotable or rotatable relative to the main cabinet 52, but not slidable. In the embodiment illustrated in FIGS. 4-14, the mounting arms 48, 54 are attached on an exterior of the main cabinet 52.

Figure 5:
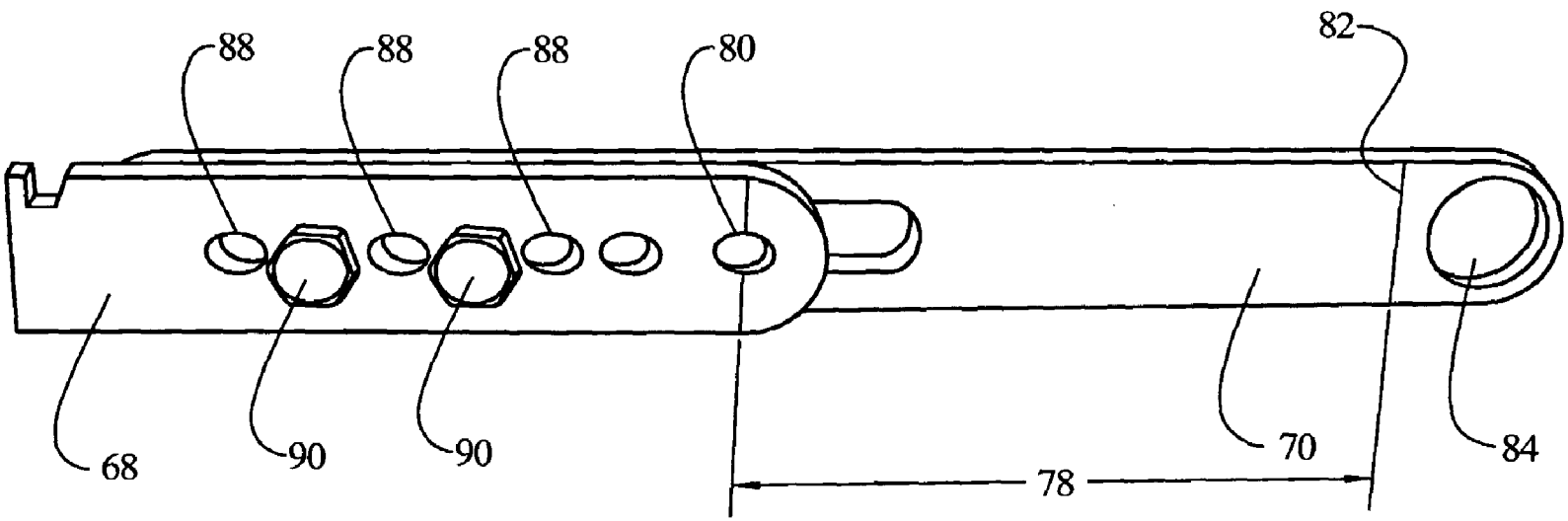
FIG. 5 is a partial side elevational view of a mounting arm of the mounting system of FIG. 4.
Figure 6:
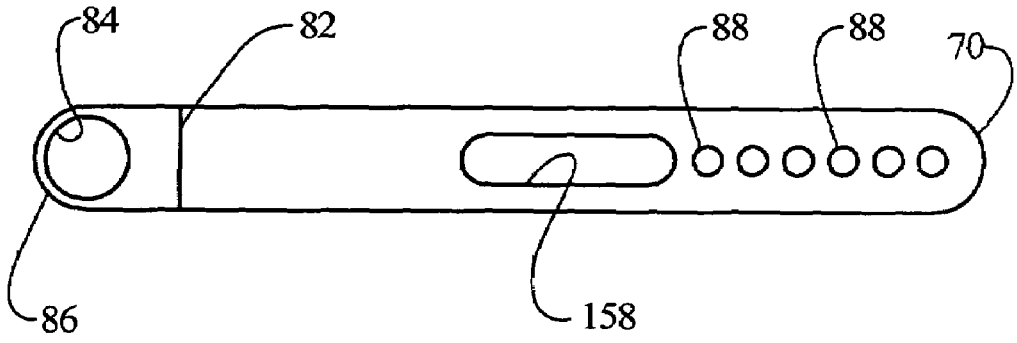
FIG. 6 is side elevational view of an inner arm of the mounting arm of FIG. 5.

A length of the mounting arms 48, 54 may be adjusted by forming each arm in two parts, an outer arm 68 and an inner arm 70, to accommodate for different wall thicknesses of a wall 72 that the air conditioner 32 is to be mounted to, and to accommodate the position of window sashes 74, 76 in the wall. Some walls may be up to 12 inches thick, including 6 inch studs and a brick exterior siding. Other walls may only be about 5 inches thick, using a 4 inch stud and thin siding. This adjustability is particularly useful where a sill bracket, as described below, is to be utilized in the mounting system 30. To make the adjustment, the user should make a measurement of a distance from the inside vertical face 44 of the casing 46 or wall surrounding the window 36 where the air conditioner 32 is to be mounted to a center of a channel in the sill 42 for the upper window sash 76 (in the case of a double hung window), or where the outside window (in the case of a single hung window) is centered. This distance should be replicated on the mounting arms 48, 54, as shown in FIG. 5, as a distance 78 from a first hole 80 in the outer arm to 68 to a marking 82 on the inner arm 70, just outward of a hole 84 at an inside end 86 of the inner arm. This marking 82 represents the approximate position that the inner arm 70 will have relative to the inside vertical face 44 of the casing 46 or wall surrounding the window 36. The adjustment is made by aligning appropriate holes 88 in the inner arm 70 and the outer arm 68, and securing fasteners 90, such as bolts, through aligned holes 88 to hold the inner and outer arms at the desired relative positions.

In this illustrated embodiment, a cross bar 92 (FIG. 8) is engaged with a second end 94 of the first and second mounting arms 48, 54. The cross bar 92 may be engaged with the arms 48, 54 by sliding through the hole 84 near the second end 94 of each of the arms. The cross bar 92 may also be engaged with the arms 48, 54 by other attachment mechanisms. The cross bar 92 may be formed in two telescoping, and optionally threaded, sections 96, 98 to permit a length of the cross bar to be adjusted so that the cross bar is substantially longer than a width of the main cabinet 52, and in fact, longer than a width of the window opening, ensuring that each end 100, 102 of the cross bar will extend beyond the window opening. A pad 104 of soft material, such as a non-marring and non-skidding material, as in an elastomeric or other material, may be applied to each end 100, 102 of the cross bar 92 for engagement with the casing 46 or wall surrounding the window, as described below. Also, lateral stops 106 may be provided on the cross bar 92 to assure that the cross bar will be centered, and remain centered in the window opening during installation of the air conditioner 32, as described below.

With the cross bar 92 assembled, the main cabinet 52 may be moved towards the window opening (FIG. 9), using the cross bar under the main cabinet to provide a gripping location for a person on each side of the main cabinet to lift the cabinet. Alternatively, the cross bar 92 may be allowed to hang down on the mounting arms 48, 54, below the main cabinet 52, as the main cabinet is moved towards the window opening, with the gripping being done directly on the main cabinet. In some embodiments, as described below, the mounting arms 48, 54 are constrained against significant pivoting or rotating movement, and so the arms will be constrained to hang down in such embodiments.

The main cabinet 52 is then set on the sill 42 of the window opening (FIG. 10), such that one wall 108 of the cabinet rests on the sill. One or more skid rails 110 (FIG. 4) are applied to this wall 108 to minimize any damage to the window sill 42, and to provide a low friction sliding surface. The cross bar 92 is grasped and used as an installation aid, and the main cabinet 52 is allowed to slide out the window opening, with the only engagement being the cabinet wall 108 on the window sill 42. Once the main cabinet 52 has slid completely out of the window opening, the cross bar 92 will engage the front face 44 of the window casing 46 to prevent the main cabinet from falling.

The mounting arms 48, 54 will rest on the sill 42, or the highest point thereof, providing vertical support for the main cabinet 52, and the cross bar 92 will engage the vertical face 44 of the window casing 46, or the wall 72 surrounding the window 36 at the padded ends 100, 102, thereby preventing any damage to the casing or wall. The lateral stops 106 on the cross bar 92 are positioned just inside of the window opening to assure that the cross bar remains centered in the window opening, and that the cross bar engages the casing 46 or wall 72 on both sides of the window opening. The main cabinet 52 now hangs suspended from the first and second mounting arms 48, 54.

Figure 12:
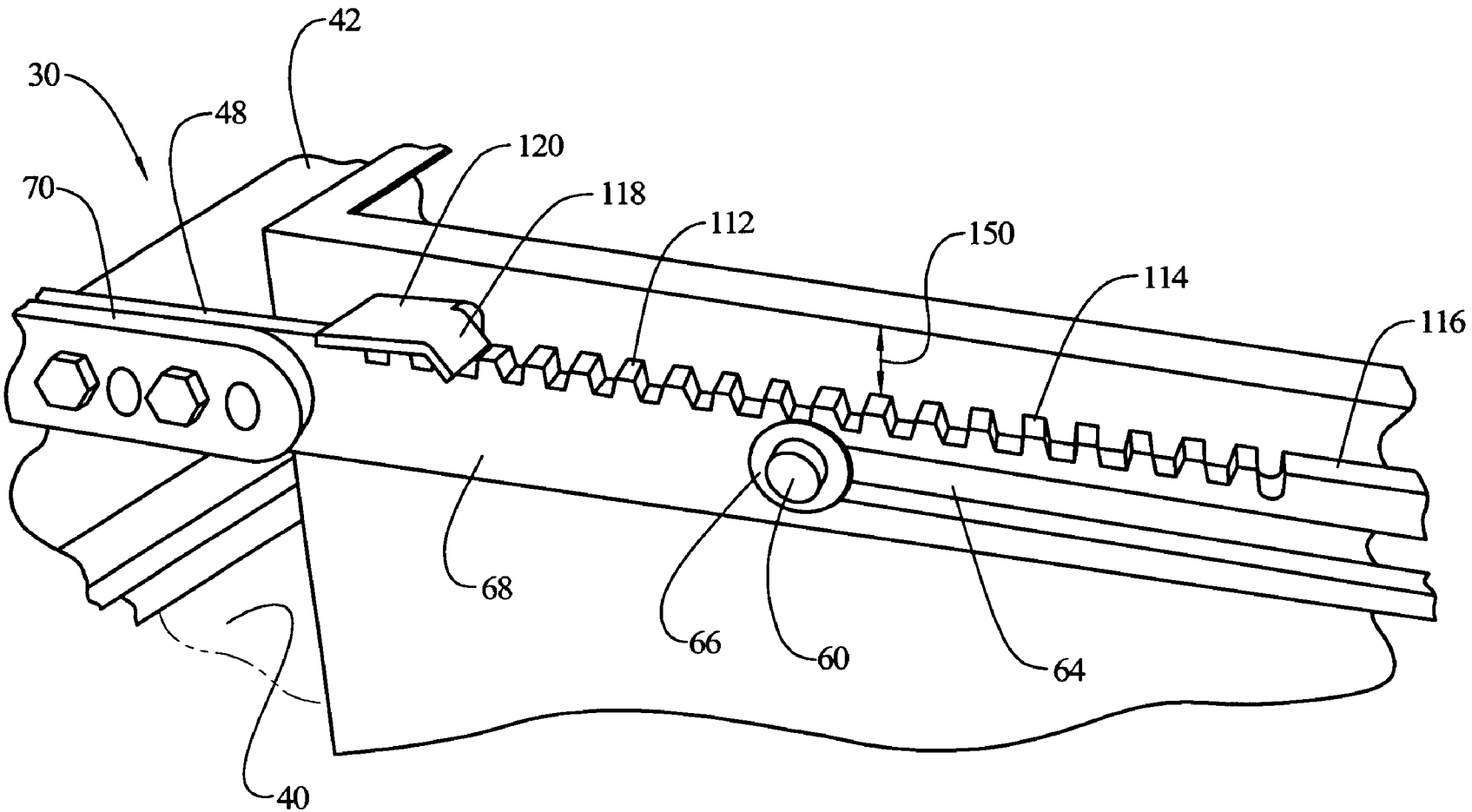
FIG. 12 is partial perspective view of the mounting arm and a ratchet mechanism.
Figure 13:
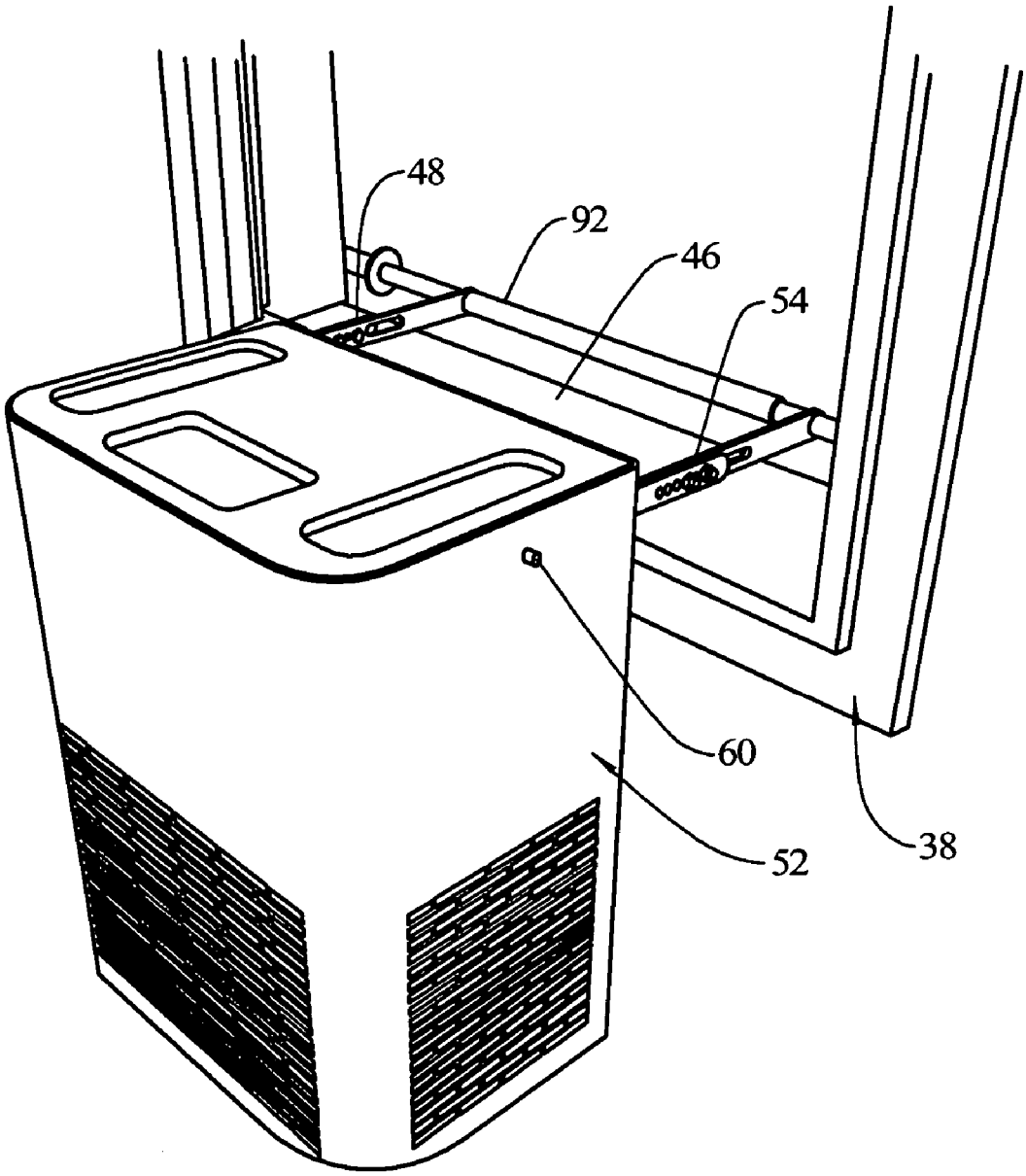
FIG. 13 is a perspective view of the main cabinet of FIG. 4 mounted outside the window, as viewed from outside.
Figure 14:
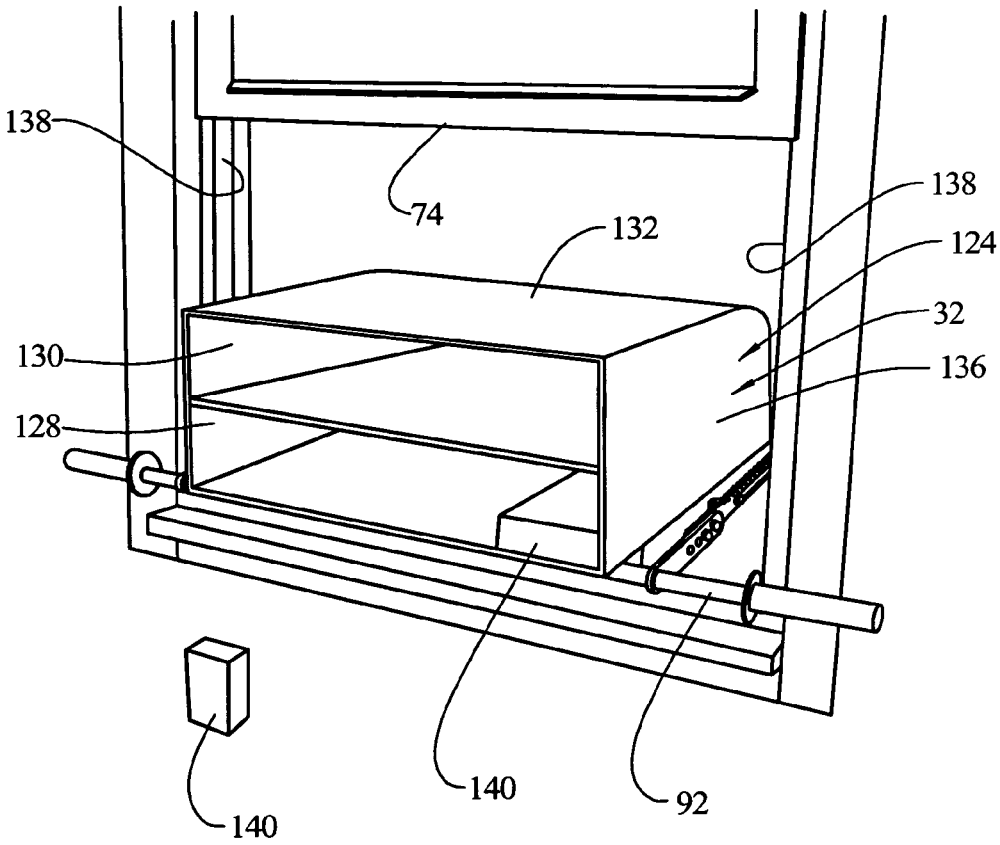
FIG. 14 is a perspective view of the mounted air conditioner with the air duct installed.

In the illustrated embodiment, the position of the suspended main cabinet 52 relative to the supporting arms 48, 54 (and the building 34) may be adjusted once the main cabinet has been mounted outside of the window. This adjustability will allow the mounting system 30 to accommodate a particular thickness of the building wall 72 in which the window is located. As mentioned above, building walls may have a range in thickness of between 5 to 12 inches. The adjustable position of the main cabinet 52 relative to the arms 48, 54 may be accomplished by grasping the main cabinet and pulling it towards the inside of the room to be cooled until the main cabinet engages the exterior siding 40 of the building 34. Since the bearing pin 60 is positioned in the glide track or slot 64, the main cabinet 52 is allowed to slide on the arms 48, 54 toward and away from the building 34, to the extent of the length of the glide track. In order to retain the main cabinet 52 in the position closest to the building 34, a linear ratchet 112 may be provided in the form of ratchet teeth 114 formed on a top edge 116 of the outer arm 68 to be engaged by a finger 118 of a ratchet pawl 120 secured to the main cabinet 52 (FIG. 12). As shown in FIG. 7, the ratchet teeth 114 may be shaped to allow for easy movement of the main cabinet 52 in one direction (towards the inside) on the arms 48, 54, and to prevent easy movement of the main cabinet in the opposite direction. The finger 118 may also be angled to assist in the one-way easy movement. The ratchet pawl 120, being secured to the main cabinet 52, provides a second function. The pawl 120, by engaging the top edge 116 of the outer arm 68, will prevent the main cabinet 52 from pivoting on the bearing pin 60, at least in one rotational direction. As shown in the view of FIG. 12, the pawl 120 will prevent the main cabinet 52 from over rotating in a counter-clockwise direction relative to the mounting arms 48, 54.

A pad 122 (FIGS. 3 and 4) may be provided on the wall 108 of the main cabinet 52 which will frictionally engage the exterior siding 40 of the building 34, once the main cabinet is pulled into engagement with the exterior siding of the building, to provide some vertical support for the main cabinet, and to prevent excessive rotation of the main cabinet relative to vertical exterior surface, in a rotational direction opposite that just described relative to the pawl 120.

Once the main cabinet 52 is secured in place, an air duct housing 124 can be attached to a top surface 126 of the main cabinet to direct a flow of air through the window opening. The air duct housing 124 has two passages 128, 130, one for air to be drawn from the room into the air conditioner 32, and the other for air to be blown back into the room, after it has been cooled and dehumidified. The air duct housing 124 may attach to the main cabinet 52 in a variety of manners, such as with a friction telescoping fit, and appropriate fasteners or retaining elements to prevent the air duct from inadvertently dislodging from the main cabinet.

The lower window sash 74 in the window opening may then be pulled down to engage a top 132 of the air duct housing 124, or a surround 134 (FIGS. 1-3) provided for sealing between sides 136 of the air duct and edges 138 of the window opening. The user is still able to open the window sash 74 with the air conditioner 32 remaining in place, and the relatively low profile of the air duct housing 124 will allow for a relatively large opening when the window is opened, to allow outside air to flow into the room, if desired.

The air duct housing 124 may also act as a housing for controls 140 for the air conditioner 32, and a passage for an electrical cord (not shown) to be plugged into a wall socket in the room to power the air conditioner. The controls 140 might also be located away from the air conditioner 32 and the air duct housing 124, and could be wireless controls utilizing RF or IR transmission capabilities such that the controls, including temperature sensors, may be located in the space to be cooled, rather than at the air conditioner, in order to provide a more accurate temperature reading of the space being cooled. Such remote and portable controls 140 would also be more convenient for a user of the air conditioner 32. The receiver of transmissions from the remote controls 140 could be located in the air duct housing 124 or in the main cabinet 52.

Thus, in this embodiment, the mounting system provides a three point mounting arrangement where the air conditioner 32 is supported by the window frame sill 42, by a vertical interior face 44 or wall adjacent to the window 36, and by the exterior siding 40 of the building 34. In other embodiments, as described below, the air conditioner 32 may be supported by only the sill 42 of the frame 38 and the exterior siding 40 of the building 34, and in still other embodiments, the air conditioner may be supported only by the sill of the frame. The entire air conditioner 32 is mounted by the mounting system 30 described without requiring any fasteners to be driven into the window frame 38, the wall 72 or the exterior siding 40.

Further, in this embodiment, a combination of the air conditioner 32 and the mounting system 30 is provided for mounting the air conditioner on the exterior of the building 34 adjacent to the window 36 with a height 142 (FIG. 3) of a visible window area measured from the lower sill 42 to an upper horizontal frame member 144. The combination comprises the air conditioner 32 including the main cabinet 52 and the removable air duct housing 124. The combination further comprises the mounting system 30 including two mounting arms 48, 54, each arm being attached at a first point to the wall 50, 58 of the main cabinet 52 and at a second point being engaged to the frame 38 of the window 36, wherein the main cabinet is suspended from the two mounting arms such that when mounted, the top surface 126 of the main cabinet is positioned at a height 146 of no more than 10% of the height 142 of the visible window area.

The top surface 126 of the main cabinet 52 will extend above the window sill 42 by an amount equal to a height 148 (FIG. 7) of the mounting arms 48, 54, and a distance 150 between the top edge 116 of the mounting arms and the top surface of the main cabinet (FIG. 12). This total amount or height 146 generally is no greater than about 2 inches (5.1 cm), whereas the height 142 of the visible window area may be in the range of 30 to 60 inches (76.5-153 cm) or more. Therefore, the top surface 126 of the main cabinet 52 may be actually positioned at no more than 4 to 7% of the height 142 of the visible window area. Thus, when the air duct housing 124 is removed, such as during the winter, or when the air conditioner 32 is not in use, without removing the air conditioner from its mounting system 30, the view out of the window 36 from the inside is nearly unblocked. Such a low profile also assists in reducing any noise transmission from the air conditioner 32 into the room.

Figure 15:
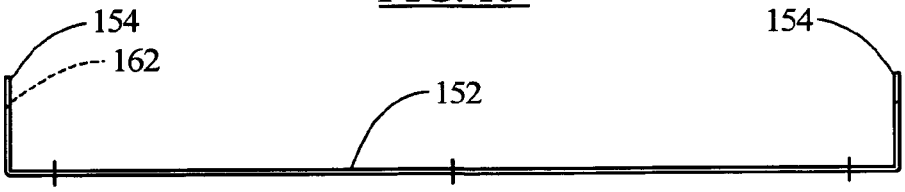
FIG. 15 is a front elevational view of winterizing bracket for the mounting system.

In order to prepare the air conditioner 32 for winterizing, for long periods of non-use, or merely to allow the window 36 to be completely closed, a sill mounting bracket 152 (FIG. 15) may be provided to allow the air conditioner to remain mounted on the exterior of the building 34, yet allowing the window to completely close. This will permit the user to avoid the task of removing the air conditioner 32 in the fall and remounting it in the spring, or even more often if it is desired to completely close the window 36 more often. To begin the process, the air duct housing 124 is removed from the top surface 126 of the main cabinet 52, so only the main cabinet remains mounted by the mounting system 30.

Figure 16:
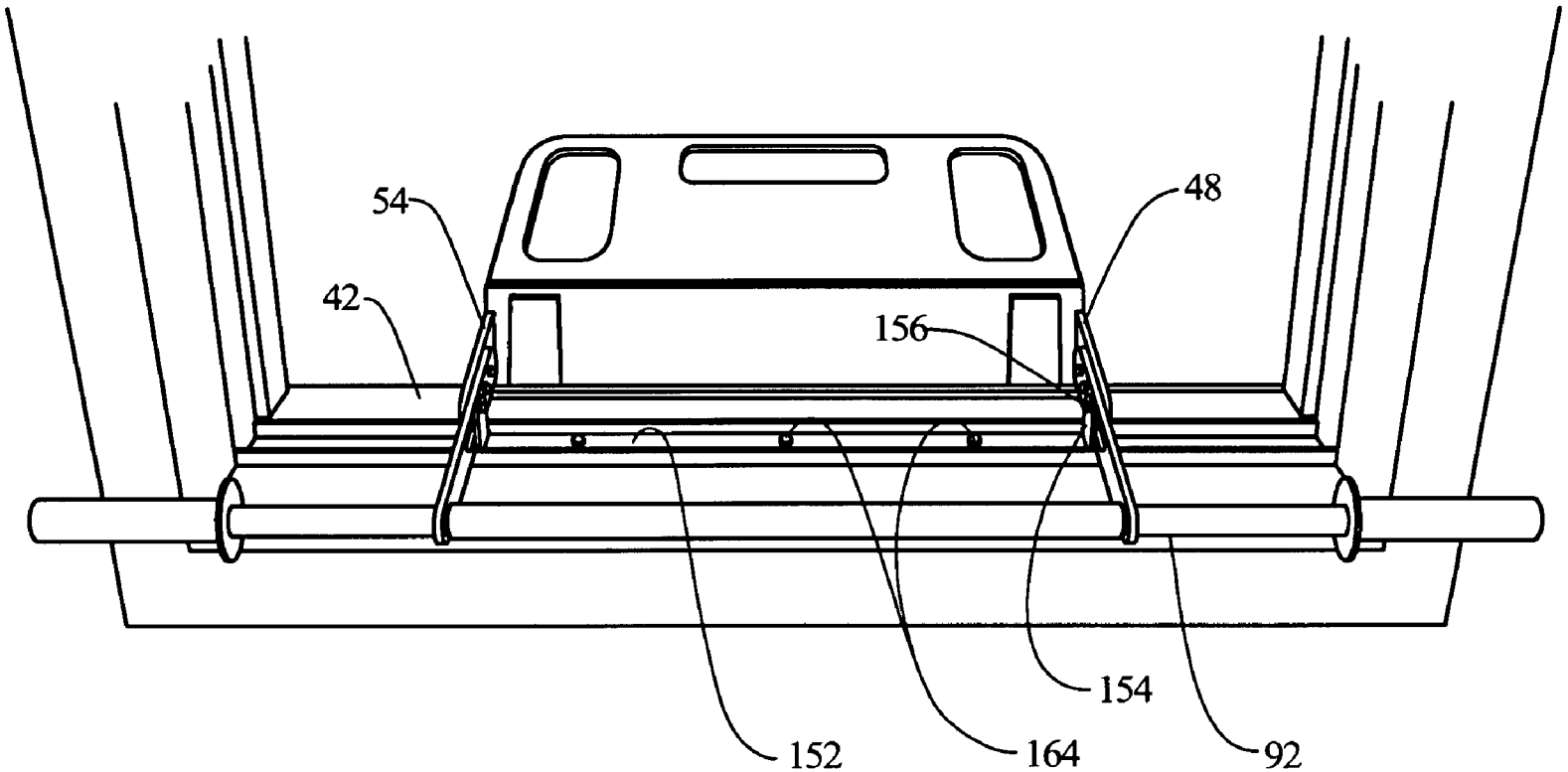
FIG. 16 is a perspective view of the winterizing bracket of FIG. 16 mounted on the window sill holding the mounted main cabinet.
Figure 17:
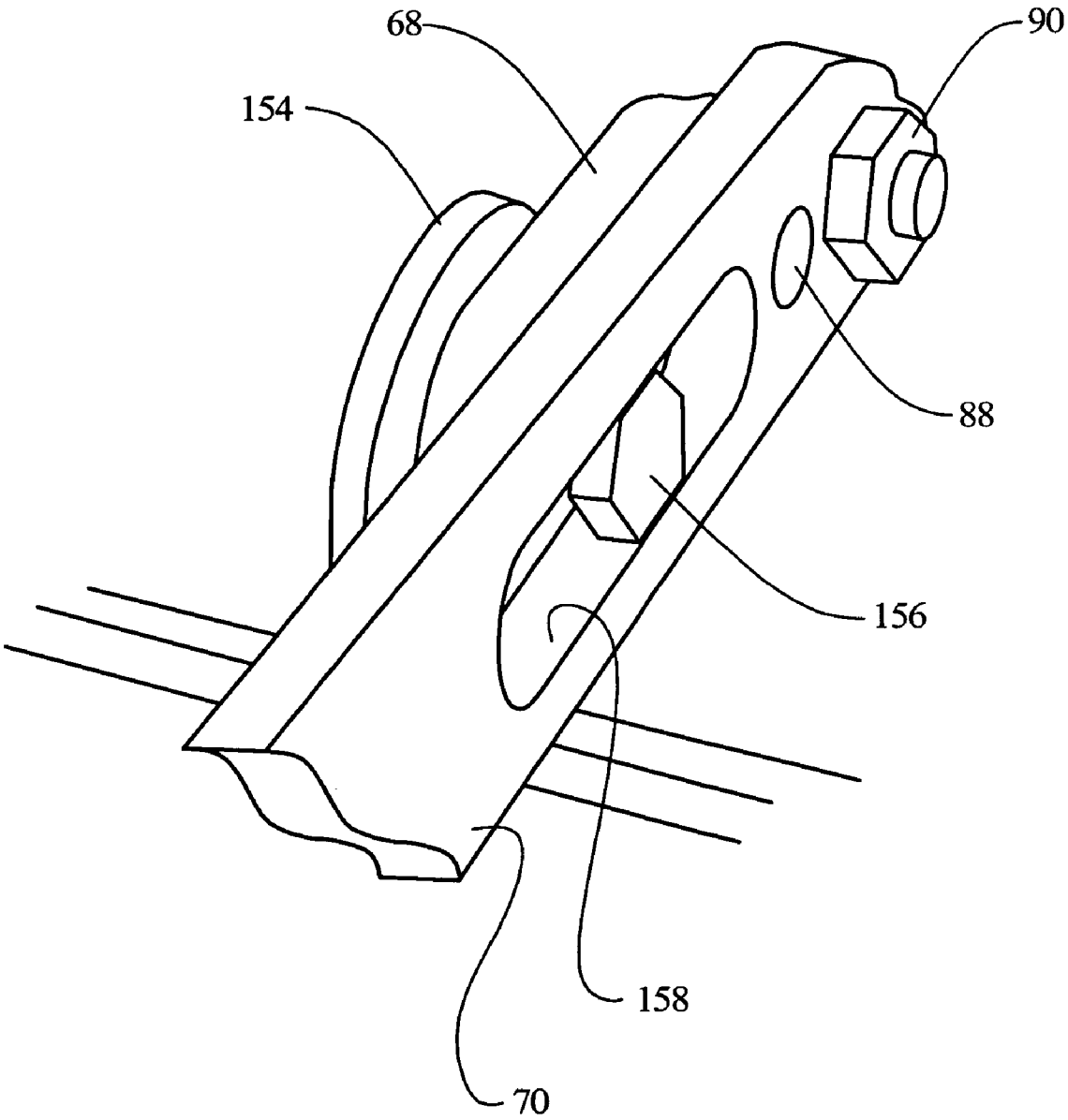
FIG. 17 is a perspective view of a fastening arrangement for the winterizing bracket of FIG. 16 relative to the mounting arm.

The sill mounting bracket 152 is shown to be a single bracket having an upstanding ear 154 at each end, however, the bracket could alternatively be formed as two separate brackets, each with an upstanding ear. The bracket 152 is sized such that the two ears 154 will be positioned just on the lateral inboard side of the mounting arms 48, 54 (FIG. 16) when the bracket is set on the sill 42 in the area representing the position of the upper window sash 76 in a single or double hung window. As shown in FIG. 17, a threaded fastener 156, such as a bolt may be inserted through a slot 158 in the inner arm 70, with the bolt extending through the hole 80 in the outer arm 68 and through a hole 162 in the ear. The ear may include a slot 162 (or alternatively, a series of vertical holes) to accommodate sills having various channels or other elements on which the mounting arms 48, 54 may be resting. The slot 158 is dimensioned to be slightly larger than a dimension across the flats of the head of the bolt 156, or the nut for the bolt, such that the slot will act as a wrench as the threaded fastener is tightened to prevent rotation of the fastener. The sill bracket 152 is then secured to the sill 42, such as by lag bolts 164, or similar fasteners.

Figure 18:
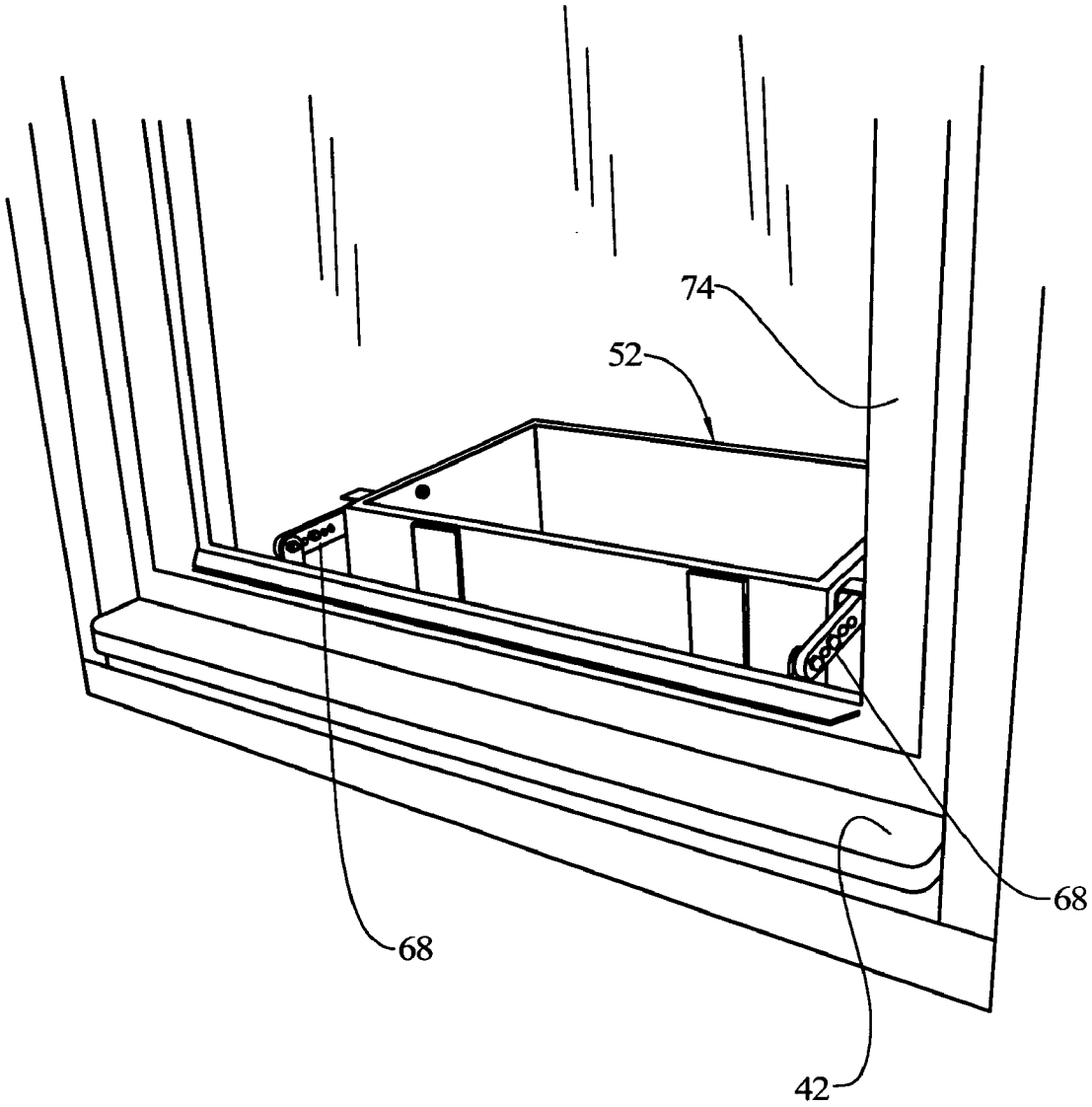
FIG. 18 is a perspective view of the main cabinet of FIG. 4 mounted outside of the window with the winterizing bracket, as viewed from inside.
Figure 19:
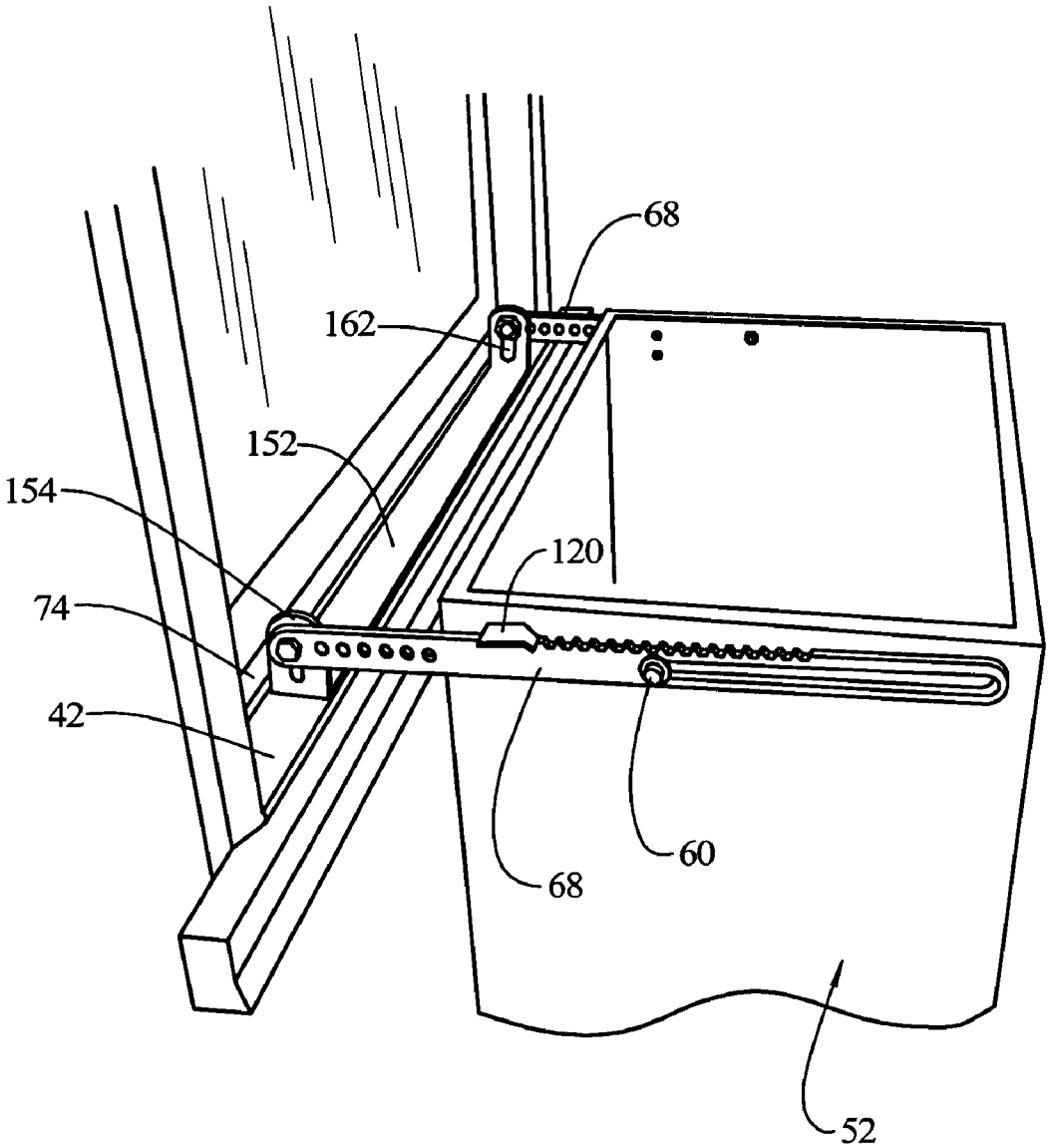
FIG. 19 is a side perspective view of the main cabinet mounted outside of the window with the winterizing bracket, as viewed from outside.
Figure 20:
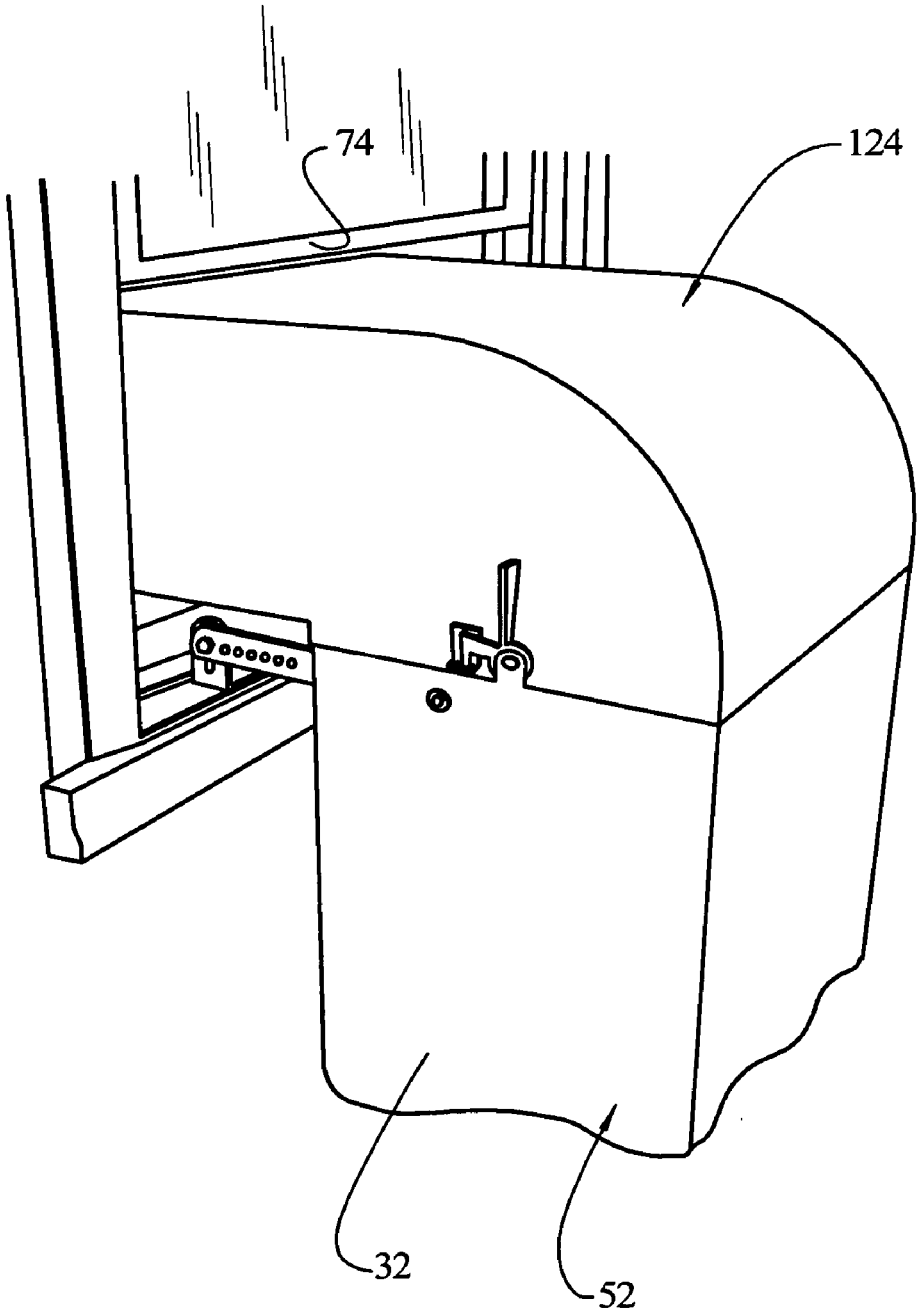
FIG. 20 is a side perspective view of the air conditioner, with assembled air duct, mounted outside of the window with the winterizing bracket, as viewed from outside.

Once the bolts 156 are secured between the sill bracket 152 and the outer arms 68 and the sill bracket is secured to the sill 42, the main cabinet 52 will be securely held by the sill bracket, and the inner arms 70 and cross bar 92 may be removed from the mounting system 30. To accomplish this, the bolts 90 holding the inner 70 and outer 68 arms together are removed, and the inner arm can then be moved away from the outer arm, since the bolt 156 holding the sill bracket 152 to the outer arm is merely positioned in the slot 158, but is not otherwise engaged to the inner arm. With the inner arms 70 and the cross bar 92 removed, the window sash 74 may be closed, while the main cabinet 52 remains mounted on the exterior of the building 34 (FIGS. 18 and 19). At this point, the air conditioner 32 is supported at two points, the sill 42 and the exterior siding 40 of the building 34 (or only one point if no pad 122 is present). Future use of the air conditioner 32 will not require the replacement of the inner arms 70 and cross bar 92, so reattachment of the air duct housing 124 (FIG. 20) is all that is required.

Figure 21:
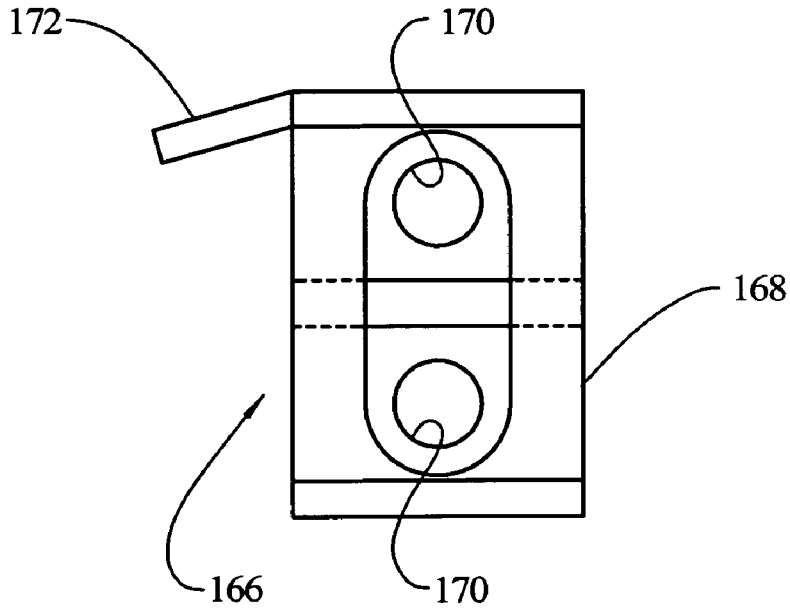
FIG. 21 is a side elevational view of an alternate ratchet pawl for use with the mounting system.
Figure 22:
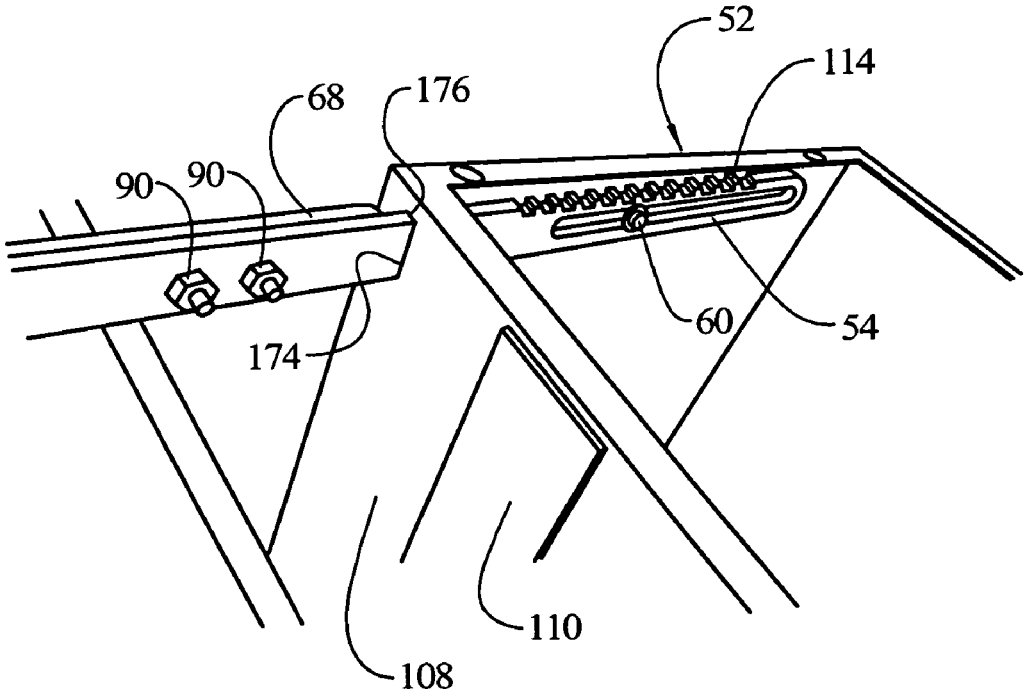
FIG. 22 is a partial perspective view of an alternate mounting arrangement for the mounting arms to the main cabinet.

An alternate embodiment of the ratchet pawl 120 is shown in FIG. 21. In this embodiment, a ratchet pawl 166 comprises a bracket 168 to be attached to the main cabinet 52, such as with threaded fasteners through holes 170 in the bracket, and the bracket will completely surround the outer arm 68, such that rotation or pivoting of the arm will be substantially prevented. The bracket 168 will allow for minor rotation of the arm 68, to allow for movement of a pawl finger 172 in the ratchet teeth 114, however the arm will be held generally perpendicular to the wall 108 of the main cabinet 52 that faces the exterior siding 40.

An alternate embodiment of the mounting of the mounting arms 48, 54 on the main cabinet 52 is shown in FIGS. 22-25, where it is shown that the outer arm 68 is secured on the interior of the side walls 50, 58 of the main cabinet, and the outer arm exits the main cabinet through an opening 174 formed in the wall 108 of the cabinet that faces the exterior siding 40 of the building 34. The opening 174 is sized slightly larger than the outer arm 68, so that minor rotation or pivoting of the arm will be allowed relative to the main cabinet 52. An edge 176 of the cabinet opening 174 may act as the ratchet pawl finger, to engage with the ratchet teeth 114 provided on the outer arm 68. Thus, in this embodiment, the mounting arms 48, 54 will be held generally perpendicular to the wall 108 of the main cabinet 52 that faces the exterior siding 40.

Figure 23:
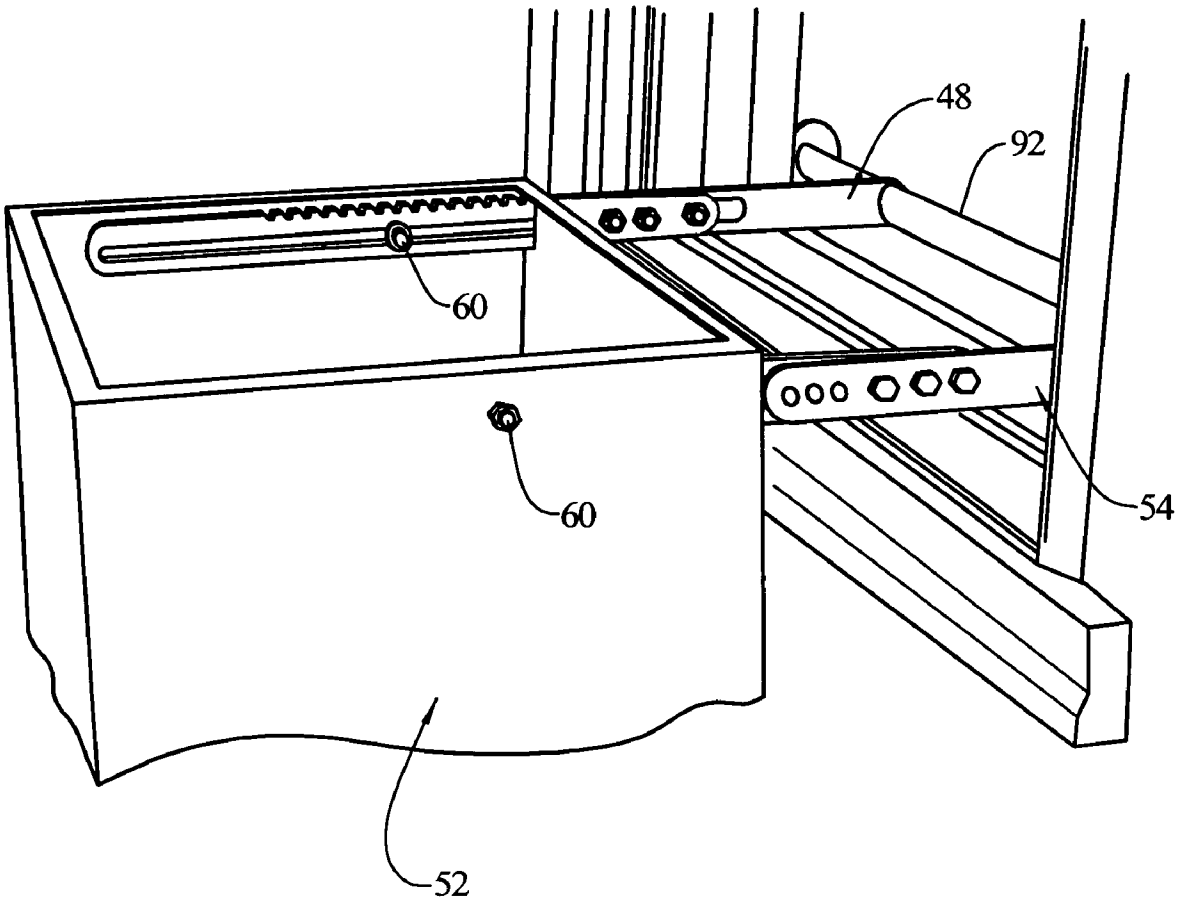
FIG. 23 is a perspective view of the main cabinet mounted outside of the window with the alternate mounting arrangement for the mounting arms, as viewed from the outside.
Figure 24:
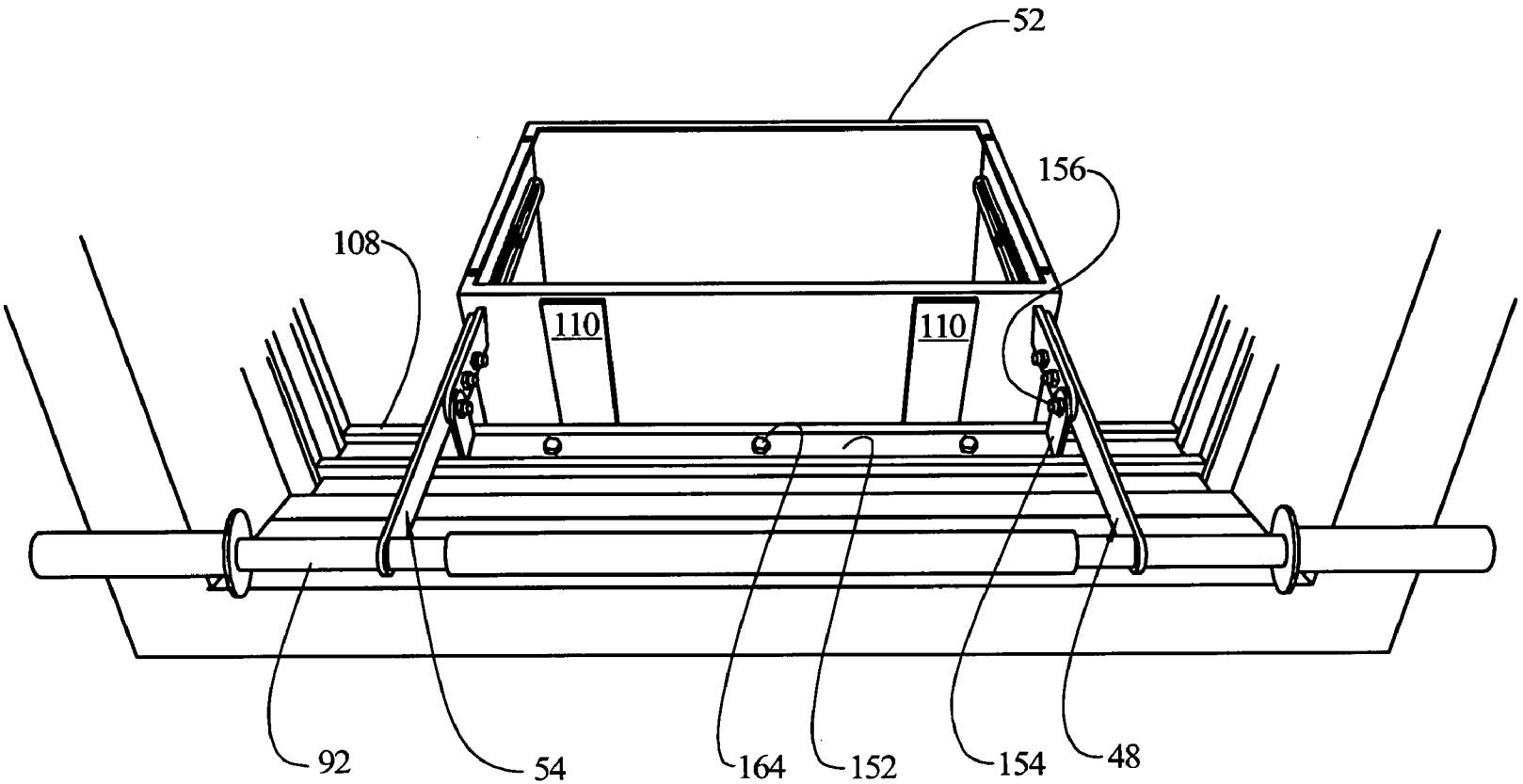
FIG. 24 is a perspective view of the main cabinet mounted outside of the window with the alternate mounting arrangement for the mounting arms, as viewed from the inside.

In all other respects, this embodiment is similar to the embodiment first described above, such that the mounting system 30 provides a three point mounting arrangement where the air conditioner 32 is supported by the window frame sill 42, by a vertical interior face 44 or wall 72 adjacent to the window 36, and by the exterior siding 40 of the building 34, when the cross bar 92 is utilized (FIGS. 23-24). In other mounting arrangements, such as when the sill bracket 152 is installed, the air conditioner 32 may be supported by only the sill 42 of the frame 38 and the exterior siding 40 of the building 34, or only by the sill of the frame (when no pad 122 is provided)(FIG. 25).

Also, in this embodiment, a combination of the air conditioner 32 and the mounting system 30 is provided for mounting the air conditioner on the exterior of the building 34 adjacent to the window 36 with a height 142 (FIG. 3) of the visible window area measured from the lower sill 42 to an upper horizontal frame member 144. The combination comprises the air conditioner 32 including the main cabinet 52 and the removable air duct housing 124. The combination further comprises the mounting system 30 including two mounting arms 48, 54, each arm being attached at a first point to the wall 50, 58 of the main cabinet 52 and at a second point being engaged to the frame 38 of the window 36, wherein the main cabinet is suspended from the two mounting arms such that when mounted, the top surface 126 of the main cabinet is positioned at a height 146 of no more than 10% of the height 142 of the visible window area. The same dimensions and ranges as described above pertain to this embodiment.

Figure 25:
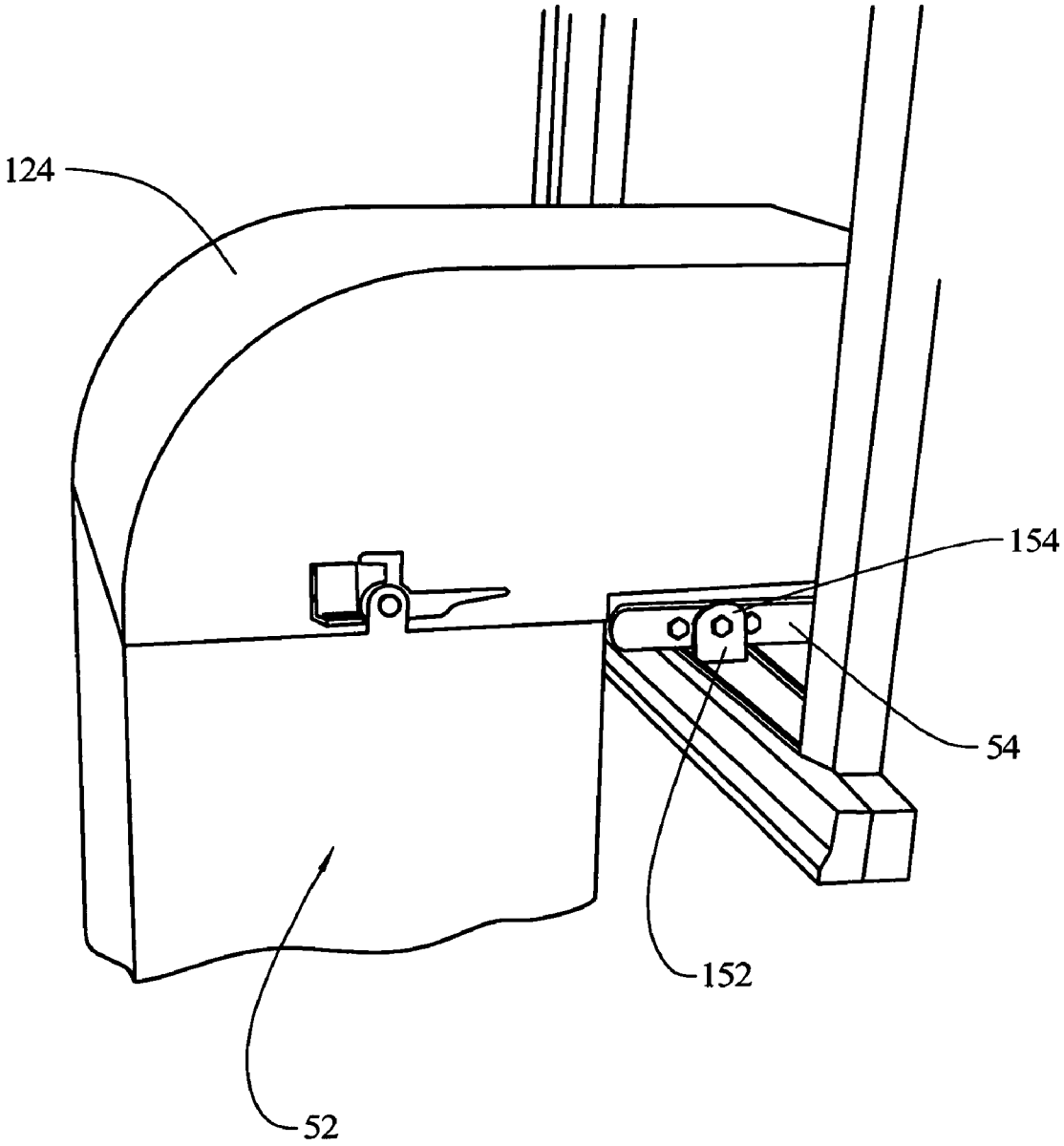
FIG. 25 is a perspective view of the air conditioner, with assembled air duct, mounted outside of the window with the alternate mounting arrangement for the mounting arms and the sill bracket, as viewed from the outside.

In this embodiment, the sill bracket 152 can be attached to the outer arms 68 and secured to the sill 42 as described above, so that the air conditioner 32 will be mounted solely by the sill bracket, and perhaps the wall pad 16 (FIG. 25).

In an embodiment, a method is provided of installing an air conditioner 32 having a cabinet 52 through an opening 36 of a predetermined width in a wall 72 of a building 34 from a room side of the wall. The method comprises the steps of:

attaching an arm 48 to the cabinet 52 of the air conditioner 32 such that a free end 86 of the arm is positioned away from the cabinet, attaching a cross bar 92 with a length greater than the width of the opening 36 to the arm 48 at the free end 86, lifting the air conditioner cabinet 52 and inserting it into the opening 36 from the room side of the wall 72 with the arm 48 and the cross bar 92 positioned toward an interior of the room, setting the air conditioner cabinet 48 on a sill 42 of the opening 36, and sliding the air conditioner cabinet 52 further out of the opening 36, while holding the cross bar 92, until the air conditioner cabinet is fully outside of the building 34 and the cross bar engages a room side face 44 of the wall 72 surrounding the opening.

In an embodiment, the step of attaching an arm 48 comprises attaching two arms 48, 54 to the cabinet, and the step of attaching a cross bar 92 comprises attaching the cross bar to a free end 86 of both arms.

In an embodiment, the step of attaching a cross bar 92 to the arm 48 comprises sliding the cross bar into an opening 84 in the arm.

In an embodiment, the step of attaching an arm 48 comprises attaching the arm in a slidable fashion to the cabinet 52.

In an embodiment, the method further includes the step of sliding the cabinet 52 on the arms 48, 54 toward the building 34 after the air conditioner cabinet is positioned fully outside of the building.

In an embodiment, the method further includes the step of attaching a sill bracket 152 to an outer arm 70 of the mounting arm 48, securing the sill bracket to the window sill 42, and removing an inner arm 68 of the mounting arm and the cross bar 92.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A mounting system for an air conditioner that has a cabinet for receiving the components of the air conditioner, said mounting system comprising:

two mounting arms;

each arm having a first length slidably attached at one end to a side wall of said cabinet, and a second length secured to a second end of said first length to provide an adjustable length for said arm, said two mounting arms being attached to opposite side walls of said cabinet; and a cross bar engaged with a free end of each of said second lengths and extending to ends positioned laterally beyond said side walls of said cabinet.

2. A mounting system according to claim 1, wherein said first length of each arm is pivotably attached to said cabinet.

3. A mounting system according to claim 1, wherein said first length of each arm includes ratchet teeth engagable with a ratchet pawl carried on said cabinet.

4. A mounting system according to claim 1, wherein a bearing pin projects from said opposite walls of said cabinet, and said first length of each arm is slidably mounted on one of said bearing pins.

5. A mounting system according to claim 4 wherein each arm includes a glide track for receiving said bearing pin.

6. A mounting system according to claim 1, wherein said mounting system further comprises a pad secured to a wall of said cabinet and frictionally engagable with an exterior surface of a building where said air conditioner is to be used.

7. A mounting system according to claim 1, wherein low friction skid rails are applied to an exterior of a wall of said air conditioner cabinet.

8. A mounting system according to claim 1, wherein non-marring and non-skidding pads are applied to said cross bar.

9. A mounting system according to claim 1, wherein said cross bar includes lateral stops positioned intermediate the ends of said cross bar.

10. A three point mounting system for mounting an air conditioner on the exterior of a building adjacent to a window, wherein said air conditioner is supported solely by a sill of said window, an inside casing of said window and an exterior surface of said building, said mounting system comprising:

a first and second mounting arm, each attached at one end to a left and right side of a cabinet of said air conditioner;

a cross bar engaged with a second end of said first and second mounting arms; and a pad secured to a wall of said air conditioner cabinet;

wherein said first and second mounting arms rest on said window sill, said cross bar engages an inside face of said inside casing and said pad engages said exterior surface of said building.

11. A three point mounting system according to claim 10, wherein said air conditioner hangs suspended from said first and second mounting arms.

12. A three point mounting system according to claim 10, wherein said first and second mounting arms are pivotally attached to said air conditioner.

13. A three point mounting system according to claim 10, wherein said first and second mounting arms are slidably attached to said air conditioner.

14. A three point mounting system according to claim 10, wherein a length of said arms is adjustable.

15. A three point mounting system according to claim 10, wherein said first and second arms include a linear ratchet.

16. In combination, an air conditioner and a mounting system for mounting said air conditioner on the exterior of a building adjacent to a window with an opening defined by a window frame having a lower sill and a height to an upper horizontal frame member, comprising:

said air conditioner including a main cabinet and a removable air duct, and said mounting system including two mounting arms, each arm being attached at a first point to a wall of said main cabinet and at a second point being engaged to said frame of said window, wherein said main cabinet is suspended from said two mounting arms such that when mounted, a top surface of said main cabinet is positioned at a height of no more than 10% of said height of said window opening above said sill of said window frame.

17. A combination according to claim 16, wherein said arms have an adjustable length.

18. A combination according to claim 16, wherein said mounting system further includes a pad secured to said main cabinet and positioned to engage an exterior surface of said building.

19. A combination according to claim 16, wherein each of said arms is attached to said wall such that said arm is slidable relative to said main cabinet.

20. A combination according to claim 16, wherein said air duct is attached to said top surface of said main cabinet and has a portion extending into said window opening.

21. A combination according to claim 16, wherein each of said second points of said mounting arms is engaged to said window frame by means of a bracket secured to said window sill, each of said arms being bolted to said bracket (one or two brackets).

22. A combination according to claim 16, wherein said second points of said mounting arms are engaged to said frame by means of a cross bar engaging a room side face of said window frame and said arms being attached to said cross bar.

23. A combination according to claim 16, wherein said arms have an adjustable length.

24. A method of installing an air conditioner having a cabinet through an opening of a predetermined width in a wall of a building from a room side of said wall, comprising:

attaching an arm to said cabinet of said air conditioner such that a free end of said arm is positioned away from said cabinet, attaching a cross bar with a length greater than said width of said opening to said arm at said free end, lifting said air conditioner cabinet and inserting it into said opening from said room side of said wall with said arm and said cross bar positioned toward an interior of said room, setting said air conditioner cabinet on a sill of said opening, sliding said air conditioner further out of said opening, while holding said cross bar, until said air conditioner is fully outside of said building and said cross bar engages a room side face of said wall surrounding said opening.

25. A method according to claim 24, wherein said step of attaching an arm comprises attaching two arms to said cabinet, and said step of attaching a cross bar comprises attaching said cross bar to a free end of both arms.

26. A method according to claim 24, wherein said step of attaching an arm comprises attaching said arm in a slidable fashion to said cabinet.

27. A method according to claim 26, further including the step of sliding said cabinet on said arms toward said building after said air conditioner is positioned fully outside of said building.

28. A method according to claim 24, wherein said step of attaching a cross bar to said arm comprises sliding said cross bar into an opening in said arm.

29. A method according to claim 24, further including the step of attaching a sill bracket to an outer arm of the mounting arm, securing the sill bracket to the window sill, and removing an inner arm of the mounting arm and the cross bar.

* * * * *